US006968751B2

(12) United States Patent
Shulenberger et al.

(10) Patent No.: US 6,968,751 B2
(45) Date of Patent: Nov. 29, 2005

(54) AXIAL PISTON MACHINES

(75) Inventors: Arthur Melvin Shulenberger, Brisbane, CA (US); Luc Patrick Deschaumes, Brisbane, CA (US)

(73) Assignee: Innovation Engineering, Inc., Brisbane, CA (US)

( * ) Notice: Subject to any disclaimer, the term of this patent is extended or adjusted under 35 U.S.C. 154(b) by 36 days.

(21) Appl. No.: 10/762,167

(22) Filed: Jan. 21, 2004

(65) Prior Publication Data

US 2005/0155488 A1 Jul. 21, 2005

(51) Int. Cl.[7] ..... F16H 23/00
(52) U.S. Cl. ..... 74/60; 475/163
(58) Field of Search ..... 74/60; 92/71; 475/163, 475/336, 343

(56) References Cited

U.S. PATENT DOCUMENTS

| | | | |
|---|---|---|---|
| 575,991 | A | 1/1897 | Schonheyder |
| 748,559 | A | 12/1903 | Peet |
| 773,206 | A | 10/1904 | Hall |
| 780,549 | A | 1/1905 | Callan |
| 812,636 | A | 2/1906 | Callan |
| 821,546 | A | 5/1906 | Smallbone |
| 868,947 | A | 10/1907 | Smith |
| 876,202 | A | 1/1908 | Lege |
| 893,181 | A | 7/1908 | Macomber |
| 933,316 | A | 9/1909 | Macomber |
| 1,038,537 | A | 9/1912 | Dexter |
| 1,042,018 | A | 10/1912 | Macomber |
| 1,233,635 | A | 7/1917 | Almen |
| 1,255,973 | A | 2/1918 | Almen |
| 1,282,179 | A | 10/1918 | Brackett |
| 1,282,180 | A | 10/1918 | Brackett |
| 1,300,098 | A | 4/1919 | Almen |
| 1,316,679 | A | 9/1919 | Brackett |
| 1,346,672 | A | 7/1920 | Patton |
| 1,355,485 | A | 10/1920 | Lleo et al. |
| 1,370,927 | A | 3/1921 | Staude |
| 1,411,556 | A | 4/1922 | Almen |
| 1,520,960 | A | 12/1924 | Nagelmann |
| 1,582,076 | A | 4/1926 | Page |
| 1,637,017 | A | 7/1927 | Almen |
| 1,679,924 | A | 8/1928 | Almen |
| 1,696,676 | A | 12/1928 | Fuhr |
| 1,698,102 | A | 1/1929 | Michell |
| 1,732,659 | A | 10/1929 | Redrup |
| 1,787,493 | A | 1/1931 | Redrup |
| 1,808,380 | A | 6/1931 | Royal |
| 1,814,946 | A | 7/1931 | McGeorge |
| 1,819,137 | A | 8/1931 | Thompson |
| 1,825,691 | A | 10/1931 | Hall |
| 1,844,386 | A | 2/1932 | Harris et al. |
| 1,869,440 | A | 8/1932 | Schlenker |

(Continued)

*Primary Examiner*—Thomas E. Lazo

(57) ABSTRACT

This invention relates to internal combustion engines with cylinders arranged parallel to the main shaft and where reciprocating movements of the pistons are converted to rotation by means of a Z-crank mechanism and motion converter, or conversely to systems such as pumps and compressors wherein rotation of the Z-crank and motion converter produces reciprocating motions of the pistons. The motion converter is prevented from rotation by a reaction control shaft or by a gear train. Connecting rods are prevented from rotating about their long axes. Double-ended configurations can be either opposed cylinder or opposed piston, and may include multiple pairs of pistons with each pair in a common cylinder. The Z-crank may be moved axially for the purpose of varying the compression ratio. Variation of the compression ratio is controlled by an engine control unit and is adjusted to optimize engine performance under varying loads and other conditions.

15 Claims, 18 Drawing Sheets

U.S. PATENT DOCUMENTS 1,891,927 A 10/1932 Hall
1,895,206 A 1/1933 Ricardo
1,948,827 A 2/1934 Redrup
1,968,470 A 7/1934 Szombathy
1,978,194 A 10/1934 Gray
2,009,495 A 7/1935 Hulsebos
2,028,557 A 1/1936 Nevatt
2,042,730 A 6/1936 Redrup
2,065,790 A 12/1936 Braunwalder
2,083,730 A 6/1937 Michell
2,097,138 A 10/1937 Steele
2,105,019 A 1/1938 Turner
2,150,162 A 3/1939 Hall
2,152,351 A 3/1939 Hall
2,152,811 A 4/1939 Michell
2,216,342 A 10/1940 Hall
2,216,343 A 10/1940 Hall
2,222,294 A 11/1940 Hall
2,251,543 A 8/1941 Hulsebos
2,257,258 A 9/1941 Hulsebos
2,258,127 A 10/1941 Almen
2,258,138 A 10/1941 Hall
2,278,696 A 4/1942 George
2,282,721 A 5/1942 Hall
2,282,722 A 5/1942 Hall
2,341,203 A 2/1944 Borer
2,379,119 A 6/1945 Tucker
2,403,282 A 7/1946 Holmes
2,424,660 A 7/1947 Howard
2,451,455 A 10/1948 Willson
2,464,228 A 3/1949 Hall
2,475,295 A 7/1949 Sherman
2,583,564 A 1/1952 Hall
2,650,676 A 9/1953 Jamotte
2,737,055 A 3/1956 Dauben
2,827,792 A 3/1958 Hopkins
2,918,012 A 12/1959 Lucien
3,007,462 A 11/1961 Balzer
3,101,621 A 8/1963 Bunyan
3,180,159 A 4/1965 Girodin
3,182,644 A 5/1965 Drtina
3,196,698 A 7/1965 Liddington
3,212,483 A 10/1965 Balzer
3,257,855 A 6/1966 Dangauthier
3,276,276 A 10/1966 Dangauthier
3,319,874 A 5/1967 Welsh
3,357,209 A 12/1967 Mooney
3,398,699 A 8/1968 Stark
3,528,317 A 9/1970 Cummins
3,528,394 A 9/1970 Cummins ..... 123/58
3,910,242 A 10/1975 Hom et al. ..... 123/57 R
3,943,895 A 3/1976 Howell ..... 123/58 AA
3,945,359 A 3/1976 Asaga ..... 123/58 R
4,066,049 A 1/1978 Teodorescu et al. ..... 123/48 R
4,077,269 A 3/1978 Hodgkinson ..... 74/60
4,152,944 A 5/1979 Kemper ..... 74/191
4,166,398 A 9/1979 Girodin ..... 74/60
4,207,779 A 6/1980 Papst ..... 74/579 R
4,209,980 A 7/1980 Pronovost et al. ..... 60/517
4,433,596 A 2/1984 Scalzo ..... 74/839
4,454,779 A 6/1984 Vos ..... 74/60
4,497,284 A 2/1985 Schramm ..... 123/41.47
4,502,427 A 3/1985 Brille ..... 123/90.41
4,515,113 A 5/1985 DeLorean ..... 123/48 C
4,516,536 A 5/1985 Williams ..... 123/39
4,523,549 A 6/1985 Lacy ..... 123/58 BC
4,688,439 A 8/1987 Cureton et al. ..... 74/60
4,727,761 A 3/1988 Scalzo ..... 74/60
4,736,715 A 4/1988 Larsen ..... 123/64
4,745,814 A * 5/1988 Miller et al. ..... 74/60
4,869,212 A 9/1989 Sverdlin ..... 123/56 BC
4,905,637 A 3/1990 Ott ..... 123/58 B
4,986,226 A 1/1991 Lacy ..... 123/58 BC
5,007,385 A 4/1991 Kitaguchi ..... 123/48 B
5,027,755 A 7/1991 Henry, Jr. ..... 123/58 B
5,027,756 A 7/1991 Shaffer ..... 123/58 R
5,083,532 A 1/1992 Wiesen ..... 123/58 B
5,094,195 A 3/1992 Gonzalez ..... 123/58 BA
5,103,778 A 4/1992 Usich, Jr. ..... 123/58 AB
5,113,809 A 5/1992 Ellenburg ..... 123/58 BA
5,205,718 A 4/1993 Fujisawa et al. ..... 417/222.2
5,269,193 A 12/1993 Rabinow ..... 74/60
5,273,012 A 12/1993 Brock ..... 123/58 B
5,368,449 A 11/1994 Kimura et al. ..... 417/269
5,415,077 A 5/1995 Ono ..... 92/71
5,437,251 A 8/1995 Anglim et al. ..... 123/56.3
5,442,971 A 8/1995 Romanchev et al. ..... 74/53
5,450,823 A 9/1995 Istomin ..... 123/56.3
5,553,582 A 9/1996 Speas ..... 123/56.4
5,564,372 A 10/1996 Llewellyn ..... 123/56.3
5,638,778 A 6/1997 James ..... 123/56.6
5,749,337 A 5/1998 Palatov ..... 123/56.2
5,752,413 A 5/1998 Kuhn et al. ..... 74/60
5,762,039 A 6/1998 Gonzalez ..... 123/197.3
5,782,219 A 7/1998 Frey et al. ..... 123/56.3
5,904,044 A 5/1999 White ..... 60/443
5,950,580 A 9/1999 Birckbichler ..... 123/56.2
5,992,357 A 11/1999 Tasi ..... 123/56.2
6,003,480 A 12/1999 Quayle et al. ..... 123/56.1
6,098,578 A 8/2000 Schuko ..... 123/56
6,164,252 A 12/2000 Kuhn et al. ..... 123/56.3
6,202,606 B1 3/2001 Anttila ..... 123/56.1
6,305,334 B1 10/2001 Schuko ..... 123/56.2
6,305,335 B1 10/2001 O'Toole ..... 123/56.3
6,390,052 B1 5/2002 McMaster et al. ..... 123/247
6,397,794 B1 6/2002 Sanderson et al. ..... 123/48 B
6,487,858 B2 12/2002 Cammack ..... 60/517
2003/0046932 A1 3/2003 Isaac, Jr. et al. ..... 60/643

* cited by examiner

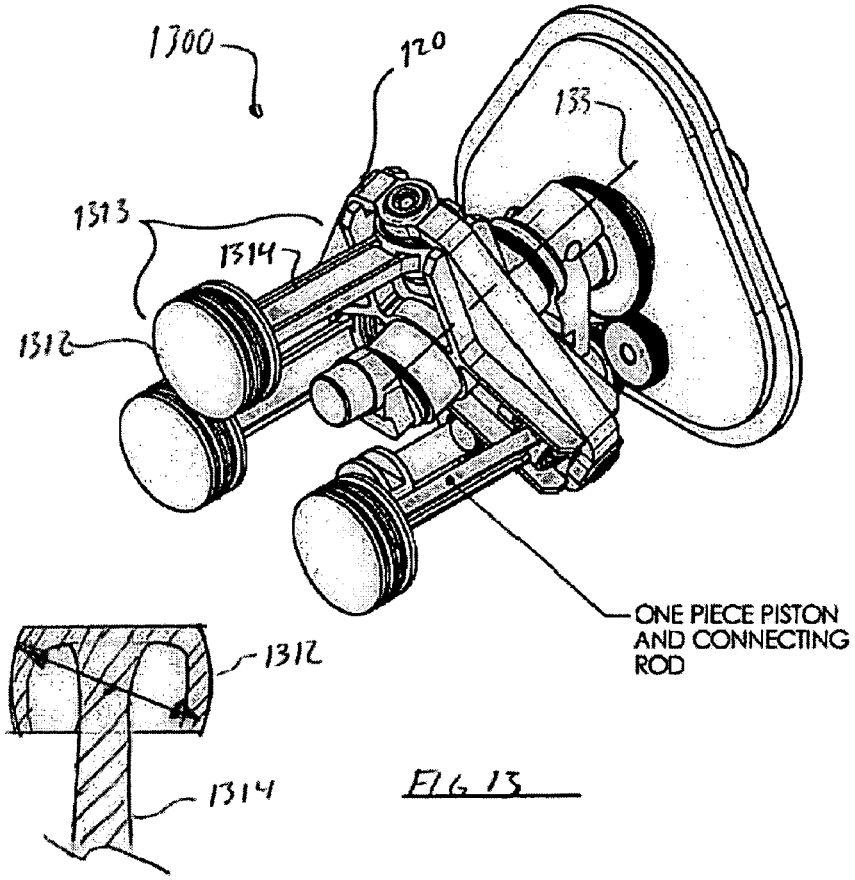
FIG 13
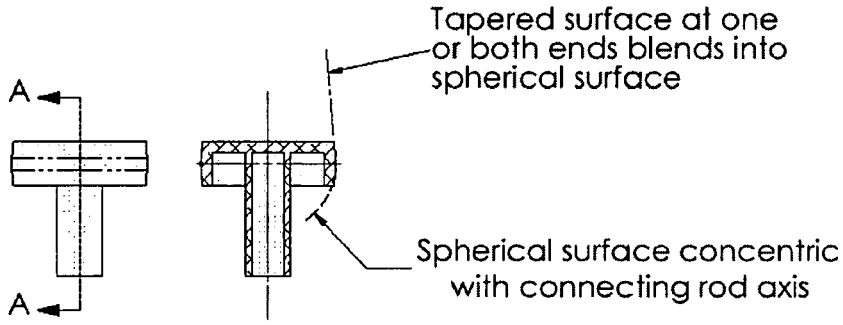
Note: grooves for piston rings omitted for clarity

AXIAL PISTON MACHINES

CROSS REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO SEQUENCE LISTING, A TABLE, OR A COMPUTER PROGRAM LISTING COMPACT DISK APPENDIX

NOT APPLICABLE

BACKGROUND OF THE INVENTION

The following disclosure relates generally to machines and apparatuses having axial piston arrangements and, more particularly, to apparatuses and methods for converting reciprocating linear motion of one or more pistons into rotary motion of an associated shaft oriented in parallel to the piston motion.

Various apparatuses are known that convert movement of a working fluid within a changeable cylinder volume into rotary motion of an input/output shaft. Conventional internal combustion engines, compressors, and pumps are just a few of such apparatuses. In conventional arrangements, the pistons are connected via connecting rods to a crankshaft that rotates on an axis oriented perpendicular to the direction of travel of the piston.

The theoretical advantages of the axial piston arrangement have been well understood for many years, but no prior effort has succeeded in the marketplace. The primary difficulty in implementing an axial piston engine is in the means provided for preventing rotation of the motion converter, or as commonly referred to, the "wobble plate."

BRIEF SUMMARY OF THE INVENTION

It is an object of the invention to reduce friction losses in internal combustion engines and the like.

Another object of the invention to provide for variable compression ratio in internal combustion engines.

A further object of the invention is to provide a piston motion that is harmonic in nature and can be readily balanced and thereby reduce vibration.

It is an additional object of the invention to provide an improved means for preventing the rotation of the motion converter in an axial piston machine.

Another object of the invention is to provide a means for preventing the rotation of the connecting rods in an axial piston machine.

Yet another object of the invention is to provide for a one-piece or rigidly attached piston and connecting rod in an axial piston machine.

BRIEF DESCRIPTION OF THE DRAWINGS

FIG. 13 is an isometric view of an axial piston apparatus configured in accordance with yet another embodiment of the invention.

DETAILED DESCRIPTION

Figure 1:
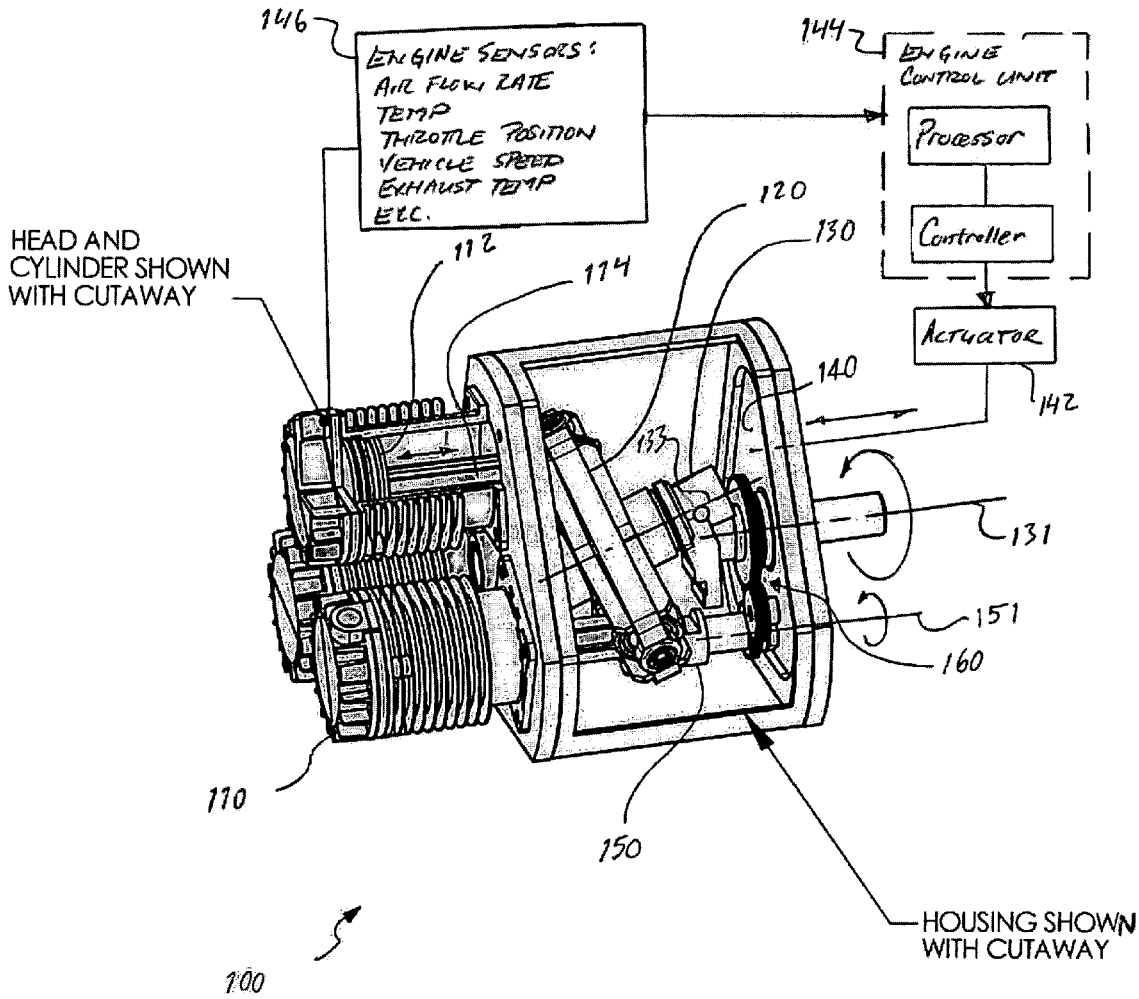
FIG. 1 is an isometric view of an axial piston apparatus configured in accordance with an embodiment of the invention.

The following disclosure is directed to apparatuses and methods for converting reciprocal linear motion of one or more pistons into rotary motion of an output power shaft whose rotational axis is parallel to ther motions of the pistons or, conversely, for converting rotary motion of a similarly configured input shaft into reciprocal linear motion of one or more pistons. Various embodiments of the invention can be applied to internal combustion engines, external combustion engines, air compressors, air motors, liquid fluid pumps, and the like where movement of a working fluid within a volume-changing cylinder results from/in rotary motion of an input/output shaft. In contrast to conventional engines, compressors, and pumps where the crankshaft's rotational axis is perpendicular to the motions of the pistons, an axial piston apparatus configured in accordance with embodiments of the present invention can have one or more cylinders aligned in parallel with the rotational axis of the input/output shaft. As described in greater detail below, such a configuration can further include the capability to dynamically vary the compression ratio in the cylinders to alter the performance characteristics of the apparatus.

Certain embodiments of the apparatuses and methods described herein are described in the context of fluid pumps, fluid compressors, and internal combustion engines of both two- and four-stroke cycle designs. Accordingly, in these embodiments, the invention can include one or more features often associated with internal combustion engines, fluid pumps, or compressors such as fuel delivery systems, ignition systems, and/or various other engine/pump control functions. Because the basic structures and functions often associated with internal combustion engines, fluid pumps, fluid compressors and the like are known to those of ordinary skill in the relevant art, they have not been shown or described in detail here to avoid unnecessarily obscuring the described embodiments of the invention.

Certain specific details are set forth in the following description and in FIGS. 1–18 provide a thorough understanding of various embodiments of the invention. Those of ordinary skill in the relevant art will understand, however, that the invention may have additional embodiments that may be practiced without several of the details described below. In addition, some well-known structures and systems often associated with engines, pumps, and compressors have not been shown or described in detail here to avoid unnecessarily obscuring the description of the various embodiments of the invention.

In the drawings, identical reference numbers identify identical or at least generally similar elements. To facilitate the discussion of any particular element, the most significant digit or digits in any reference number refers to the figure in which that element is first introduced. For example, element 130 is first introduced and discussed in reference to FIG. 1. In addition, any dimensions, angles and other specifications shown in the figures are merely illustrative of particular embodiments of the invention. Accordingly, other embodiments of the invention can have other dimensions, angles and specifications without departing from the spirit or scope of the present disclosure.

FIG. 1 is an isometric view of an axial piston apparatus 100 configured in accordance with an embodiment of the invention. For ease of reference, the phrase "axial piston apparatus" will be understood to include engines, pumps, compressors, etc. having the piston arrangement more or less as depicted, unless specifically identified otherwise. In one aspect of this embodiment, the apparatus 100 includes one or more cylinders 110 aligned in parallel with a rotational axis 131 of a Z-crank 130. Although the illustrated embodiment depicts three cylinders 110, in other embodiments, the engine 100 can include more or fewer cylinders 110 without departing from the spirit or scope of the present disclosure. As discussed in greater detail below, in those embodiments in which a four-stroke combustion process is utilized, it may be advantageous for the apparatus 100 to include an odd number of cylinders 110. In contrast, those embodiments of the apparatus 100 utilizing a two-stroke combustion process may include an odd or even number of cylinders 110.

In another aspect of this embodiment, pistons 112 reciprocate back and forth within the cylinders 110 parallel to the Z-crank rotational axis 131. The pistons 112 are connected via connecting rods 114 to a "wobble-plate" or motion converter 120. As described in greater detail below, the motion converter 120 is rotatably attached to the Z-crank 130 about a nutation axis 133 such that the Z-crank 130 is free to rotate with respect to the motion converter 120 about the nutation axis 133. Accordingly, reciprocating motion of the pistons 112 in the cylinders 110 causes the motion converter 120 to nutate or wobble (but not rotate) relative to the Z-crank rotational axis 131.

In a further aspect of this embodiment, the apparatus 100 also includes a reaction control shaft 150 slidably engaging the motion converter 130. As explained in greater detail below, the reaction control shaft 150 restricts rotational movement of the motion converter 130 while allowing the motion converter 130 to nutate relative to the Z-crank rotational axis 131. The reaction control shaft 150 is configured to accommodate this nutation by rotating about an axis 151 as the Z-crank 130 rotates about its rotational axis 131. A gear train 160 controls motion of the reaction control shaft 150 relative to the Z-crank 130.

In operation, reciprocating motion of the pistons 112 within the cylinders 110 causes the motion converter 120 to nutate relative to the Z-crank rotational axis 131. Although the motion converter 120 nutates, it does not rotate a significant amount. Nutation of the motion converter 120 causes the Z-crank 130 to rotate relative to the motion converter 120 about the nutation axis 133. Such motion also causes the Z-crank 130 to rotate about the Z-crank axis 131. While the Z-crank 130 rotates, the reaction control shaft 150 also rotates about its axis 151 (e.g., at twice the Z-crank rotational speed) to accommodate the nutational movement of the motion converter 120 while restricting rotational movement of the motion converter 120.

Accordingly, in an internal combustion engine embodiment, combustion of fuel gases in the cylinders 110 can impart linear motion to the pistons 112 which in turn causes the motion converter 120 to wobble or nutate relative to the Z-crank rotational axis 131 providing rotational shaft-power at the Z-crank 130. This shaft-power can be utilized for any one of many applications including propelling air, land, and sea vehicles. Alternatively, when used as a pump or air compressor, shaft-power can be applied to the Z-crank 130 causing it to rotate about the Z-crank rotational axis 131 and thereby nutate the motion converter 120. Nutation of the motion converter 120 in turn causes axial motion of the pistons 112 in the cylinders 110. Such motion can be used to pump water, air or another fluid to or from a reservoir or source (not shown) for many applications.

In yet another aspect of this invention, the axial arrangement of the cylinders 110 relative to the Z-crank rotational axis 131 can advantageously facilitate compression ratio changes within the cylinders 110. For example, in one embodiment the apparatus 100 can include a support plate 140 that provides rotational support to the Z-crank 130 and the reaction control shaft 150. In the illustrated embodiment, the support plate 140 can be axially movable relative to the cylinders 110 back and forth parallel to the Z-crank rotational axis 131. Accordingly, as the support plate 140 moves toward the cylinders 110, the clearance between the top of the pistons 112 and the top of the combustion chamber within the cylinders 110 is reduced. As a result, such movement of the support plate 140 causes the compression ratio within the cylinders 110 to increase. Similarly, movement of the support plate 140 away from the cylinders 110 causes the compression ratio within the cylinders 110 to decrease. As will be appreciated by those of ordinary skill in the relevant art, controlling the compression ratio within the cylinders 110 in the foregoing manner can advantageously be used to alter or optimize various performance aspects of the axial piston apparatus 100.

In one aspect of this embodiment, the axial piston apparatus 100 can include an actuator 142 operably connected to the support plate 140, and an engine control unit 144 ("ECU" 144) that provides control inputs to the actuator 142. In one embodiment, the actuator 142 can include a hydraulic actuator configured to move the support plate 140 back and forth relative to the cylinders 110. In other embodiments, other types of mechanical, hydraulic, pneumatic and other types of actuators can be used to move the support plate 140 in response to inputs from the ECU 144. The ECU 144 of the illustrated embodiment can include one or more facilities for receiving engine operating information and outputting control signals to the actuator 142. For example, in one embodiment, the ECU can include a processor and a controller. In other embodiments, the ECU can include other functionalities. In yet another embodiment, the ECU 144 may be at least substantially similar to ECUs for controlling conventional internal combustion engines. In this embodiment, however, the ECU 144, in addition to controlling engine functions such as fuel intake, ignition timing, and/or valve timing, can provide additional output signals to control the actuator 142 and move the support plate 140 in response to one or more of the engine operating parameters. In a further aspect of this embodiment, one or more engine sensors 146 can provide engine operating parameter input to the ECU 144. Such engine sensors can include, for example, airflow rate, combustion and/or exhaust temperatures, throttle position, vehicle speed, etc.

In a further aspect of this embodiment, a variable compression axial piston engine in accordance with the present invention can be utilized to optimize engine performance to suit different operating conditions. For example, when the axial piston engine is operated at idle speeds, the compression in the combustion chambers can be reduced to enhance fuel efficiency. Alternatively, at higher RPMs, the compression within the combustion chambers can be increased. In other embodiments, the variable compression aspects of the present invention can be utilized in other ways to increase efficiency or performance.

Figure 2:
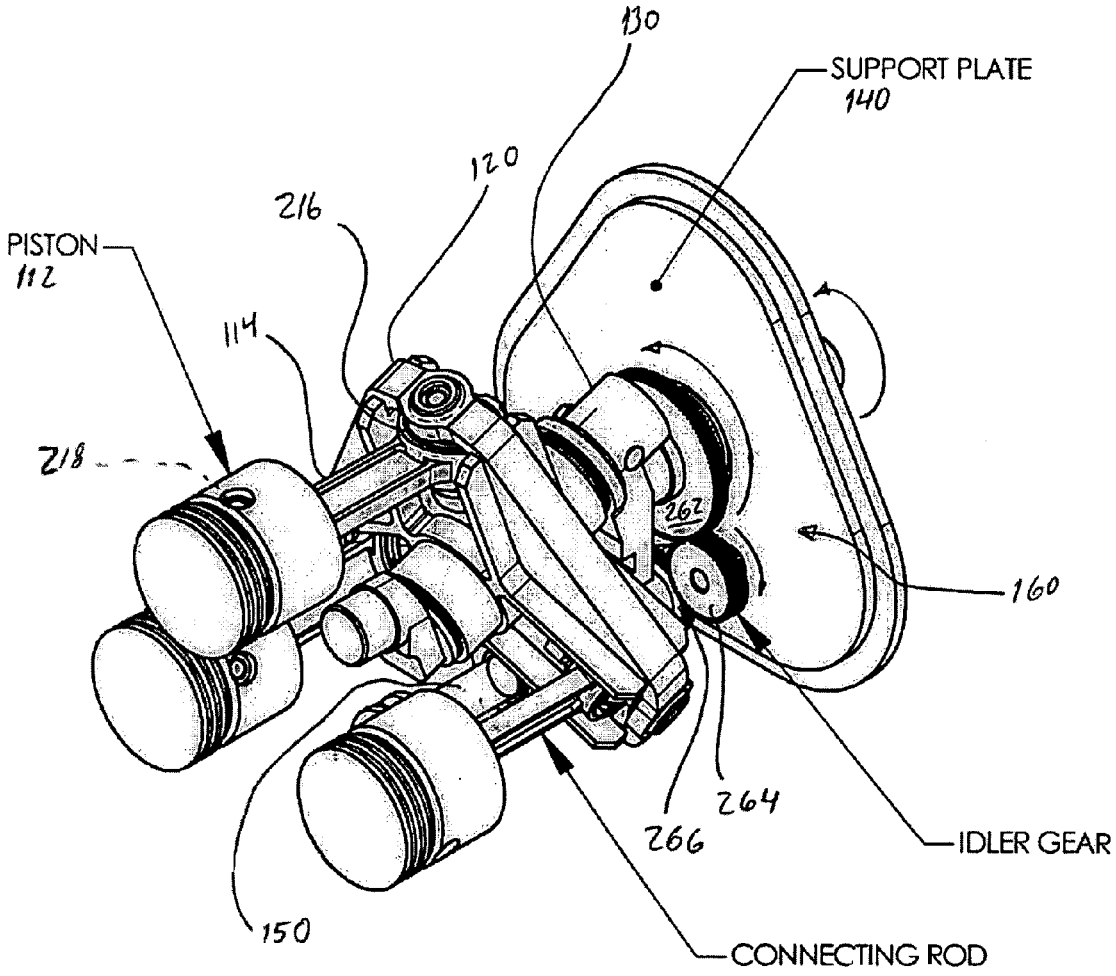
FIG. 2 is an isometric view of the axial piston apparatus of FIG. 1 with various portions removed for purposes of clarity.

FIG. 2 is an isometric view of the axial piston apparatus 100 of FIG. 1 with the cylinders and housing removed for purposes of clarity. In one aspect of this embodiment, the connecting rods 114 are double-articulating connecting rods that can accommodate rotational movement about two axes at each end. For example, an upper wrist pin 218 joining the "small end" of the connecting rod 114 to the piston 112 is configured to gimbal or rotate in at least two axes with respect to the connecting rod 114. Similarly, a lower wrist pin 216 joining the "big-end" of the connecting rod 114 to the motion converter 120 is also able to gimbal or rotate about at least two axes with respect to the motion converter 120. Details of the connecting rod attachments will be described more fully below, as will an alternate embodiment of the invention wherein the connecting rods 114 are at least substantially fixed relative to the pistons 112. In this alternate embodiment, the pistons 112 are at least partially spherically shaped, as shown in crossisection 1312 to accommodate minor tilting motions of the connecting rods 114.

The gear train 160 introduced above with reference to FIG. 1 is shown to good advantage in FIG. 2. In another aspect of this embodiment, the gear train 160 includes a Z-crank gear 262 rotatably coupled to a reaction control shaft gear 266 via an idler gear 264. Both the idler gear 264 and the reaction control shaft gear 266 can have one-half as many teeth as the Z-crank gear 262. Accordingly, this gear arrangement will cause the reaction control shaft 150 to rotate at twice the speed of the Z-crank 130. As explained in greater detail below, in one aspect of this embodiment, this speed is necessary so that an offset portion 351 of the reaction control shaft 150 that guides the motion converter 120 will complete two orbits about its rotational axis as the Z-crank 130 completes one full rotation and the motion converter 120 completes one full nutation. In other embodiments, other gear arrangements can be used to provide the requisite timing between the Z-crank 130 and the reaction control shaft 150 without departing from the spirit or scope of the present invention.

Figure 3:
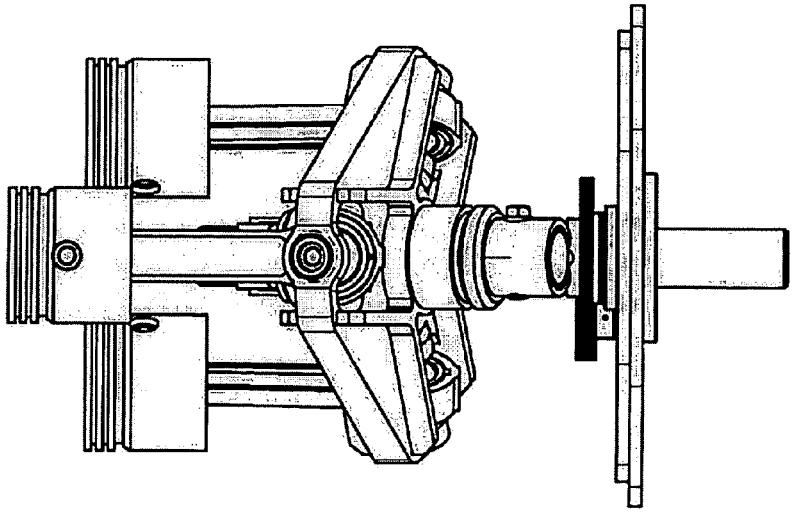
FIG. 3 illustrates a side elevation view and a top plan view of the axial piston apparatus of FIG. 2.
Figure 3:
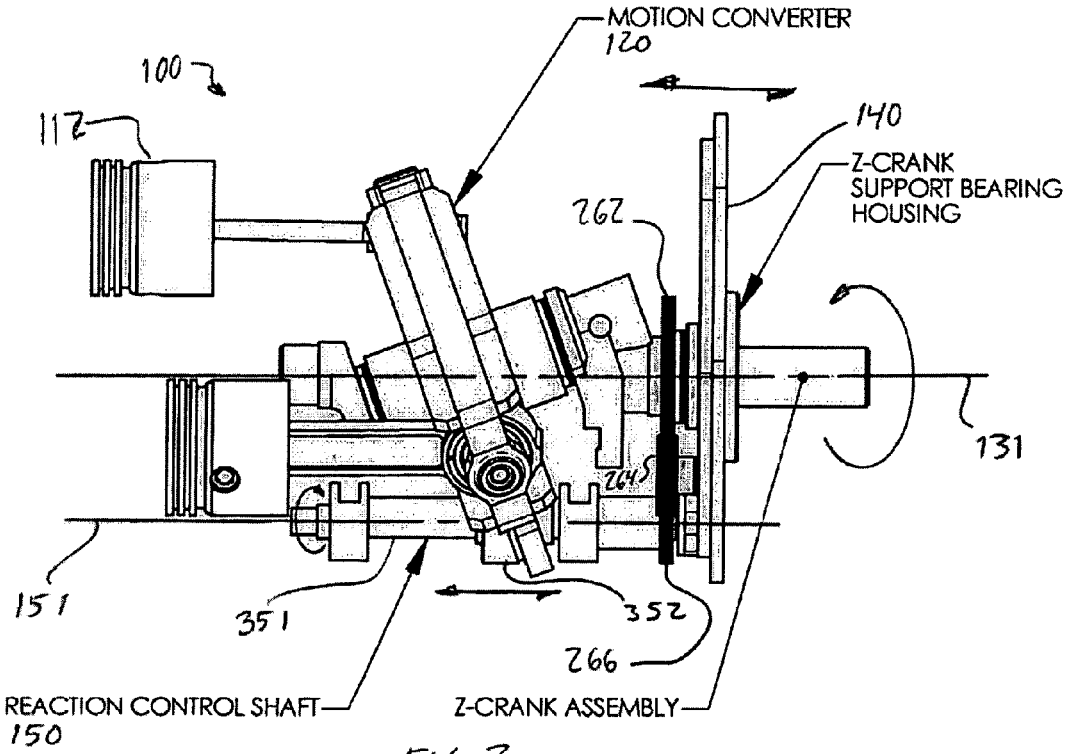

FIG. 3 includes side elevation and top plan views of the axial piston apparatus 100 of FIG. 2. FIG. 3 illustrates how fore and aft motion of the support plate 140 changes the axial position of the pistons 112 relative to the cylinders 110 (not shown) thereby changing the compression ratio in the cylinders 110. In one aspect of this embodiment, the axial piston apparatus 100 includes a reaction control bearing 352 slidably and rotatably positioned on an offset bearing surface 351 of the reaction control shaft 150. As described in greater detail below, the reaction control bearing 352 allows the motion converter 120 to nutate about the Z-crank rotational axis 131 while restricting rotational motion of the motion converter 120. The reaction control bearing 352 further allows the motion converter 120 to travel back and forth along the offset bearing surface 351 as the motion converter 120 nutates. The reaction control bearing 352 can be configured to rotate relative to the offset bearing surface 351 to accommodate rotation of the reaction control shaft 150 about its rotational axis 151.

Figure 4:
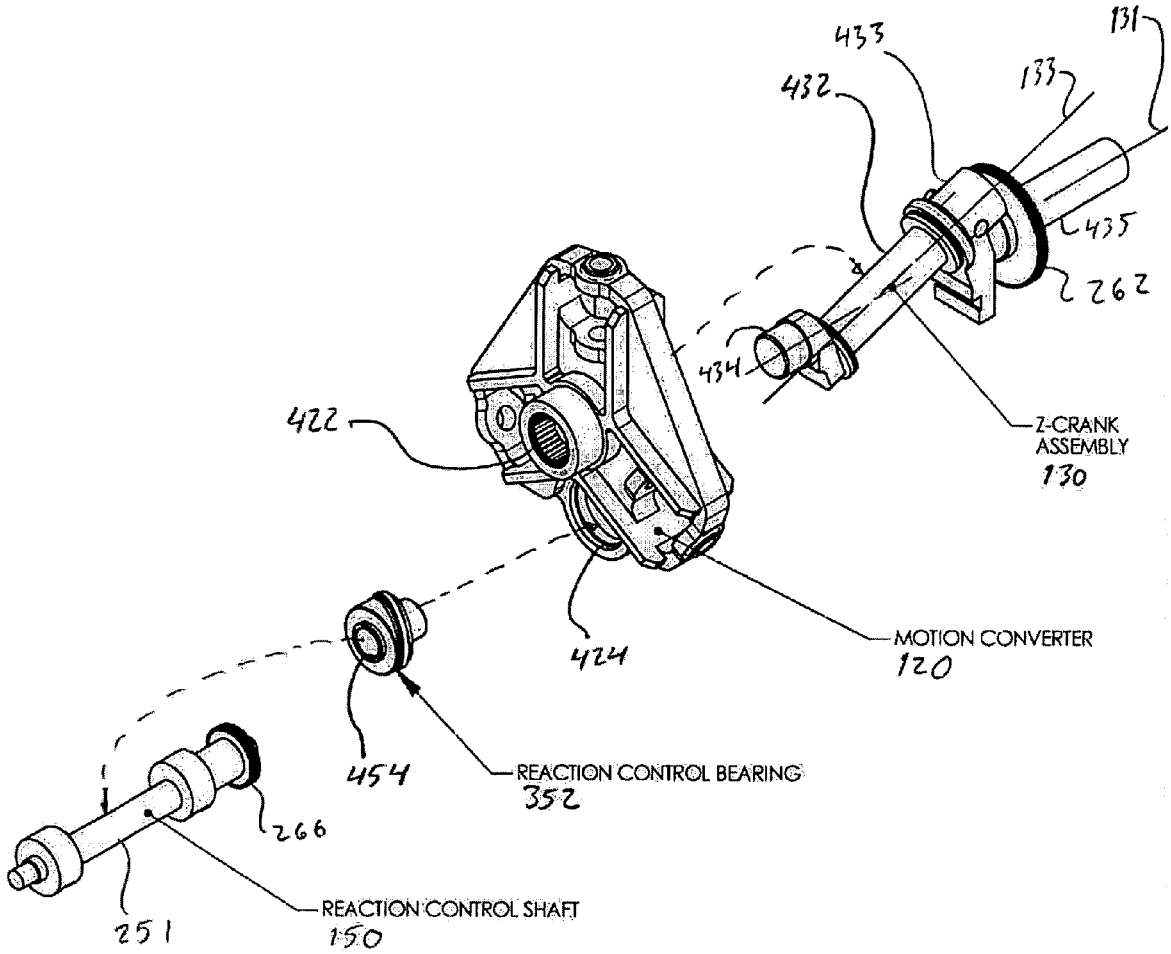
FIG. 4 is an exploded isometric view of the motion converter/Z-crank/reaction control shaft assembly of FIGS. 1–3 configured in accordance with embodiments of the invention.

FIG. 4 is an exploded isometric view of the motion converter/Z-crank/reaction control shaft assembly of FIGS. 1–3 configured in accordance with embodiments of the invention. In one aspect of this embodiment, the Z-crank assembly 130 includes a motion connection throw or bearing surface 432 configured to receive the motion converter 120. As explained above, the bearing surface 432 is aligned with the nutation axes 133. The Z-crank assembly 130 can further include fore and aft bearing surfaces 434 and 435 for rotationally supporting the Z-crank 130 relative to the housing of the axial piston apparatus 100 (FIG. 1). The fore and aft bearing surfaces 434 and 435 can be suitably supported in bearings to permit free rotation of the Z-crank 130 about the Z-crank rotational axis 131. As illustrated, the Z-crank rotational axis 131 intersects the nutational axis 133 at a location that is at least approximately centered on the motion converter bearing surface 432. Although the forward bearing surface 434 appears relatively short in FIG. 4, in other embodiments, the Z-crank 130 can extend further forward from the forward bearing surface 434 and provide rotational surfaces for actuating other mechanisms related to the axial piston apparatus 100. For example, as explained in greater detail below, in one embodiment the Z-crank 130 can be extended forward from the forward bearing surface 434 to provide camshaft lobes for actuating poppet-valves or other fluid control valves associated with combustion or pump processes.

In another aspect of this embodiment, the motion converter 120 has a centerbore 422 including one or more bearings (e.g., needle bearings) configured to rotatably receive the Z-crank bearing surface 432. The motion converter 120 can further include a reaction control bearing bore 424 radially offset from the centerbore 422 and configured to rotatably receive the reaction control bearing 352. The reaction control bearing 352 can similarly include a control shaft bore 454 configured to slidably and rotatably receive the offset bearing surface 351 of the reaction control shaft 150. The reaction control shaft gear 266 is fixed to one end of the reaction control shaft 150 and is configured to be operably engaged with the Z-crank gear 262 fixed on the Z-crank 130 proximate to the aft bearing surface 435.

Figure 5:
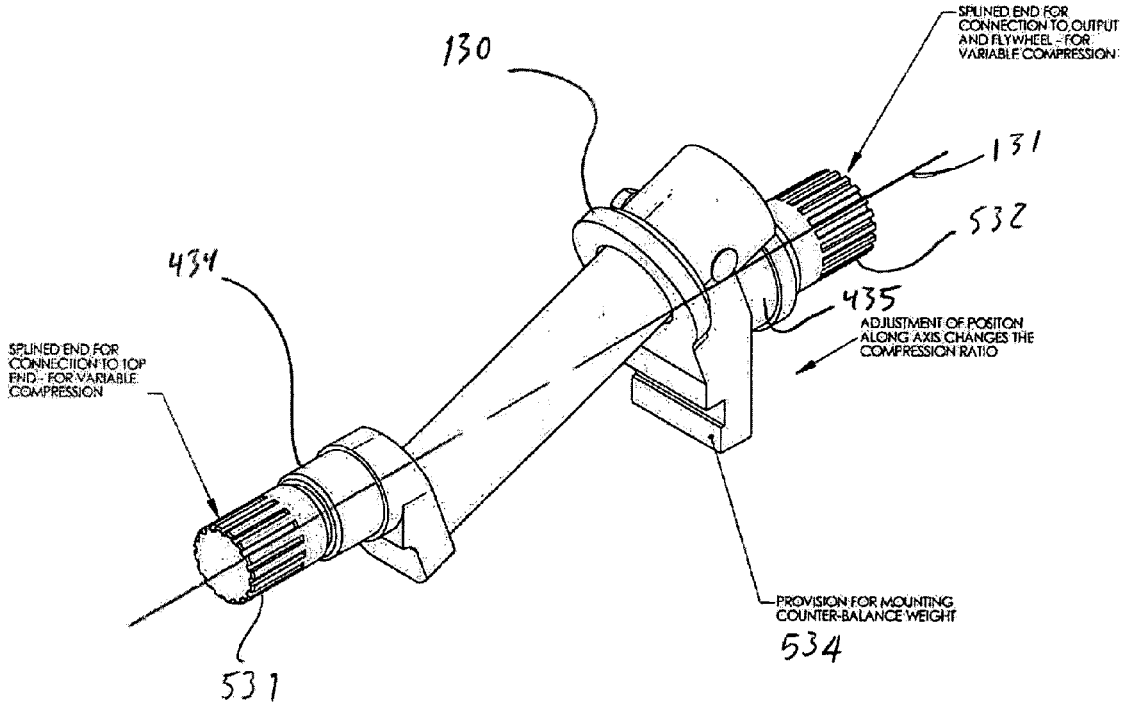
FIG. 5 is an isometric view of the Z-crank of FIG. 4 configured in accordance with an embodiment of the invention.

FIG. 5 is an isometric view of the Z-crank 130 configured in accordance with an embodiment of the invention. In one aspect of this embodiment, the Z-crank 130 can include a forward splined portion 531 positioned proximate to the forward bearing surface 434, and an aft splined portion 532 positioned proximate to the aft bearing surface 435. The splined portions illustrated in FIG. 5 can be utilized to accommodate axial movement of the Z-crank 130 relative to other parts that engage with the splined portions. For example, referring to FIG. 3 above, axial movement of the support plate 140 causes the Z-crank 130 to move fore and aft along its rotational axis 131. If the Z-crank aft splines 532 are engaged with, for example, a rotational member or other coupling that is axially (but not rotationally) fixed relative to the Z-crank 130, then the aft splined portion 532 permits the Z-crank to move fore and aft relative to such a fixed coupling. Similarly, if the forward splined portion 531 is engaged with another rotational member that is also axially fixed relative to the Z-crank 130, then the forward splined portion 531 accommodates the relative axial movement between the Z-crank 130 and the forward member. Thus, as the Z-crank/motion converter assembly moves fore and aft along the rotational axis 131 of the Z-crank 130, the splined portions on the forward and aft end of the Z-crank 130 can accommodate the relative axial motion between the Z-crank and any mating features. In other embodiments, other features can be utilized to accommodate the relative motion of the Z-crank/motion converter assembly as the Z-crank moves fore and aft to change the compression ratio in the cylinders 110 (FIG. 1).

In yet another aspect of this embodiment, the Z-crank 130 can include a counter-weight 534 laterally offset from the Z-crank rotational axis 131. If required or desirable, the counter-weight 534 can be used to dynamically balance the motion converter/Z-crank assembly.

Figure 6:
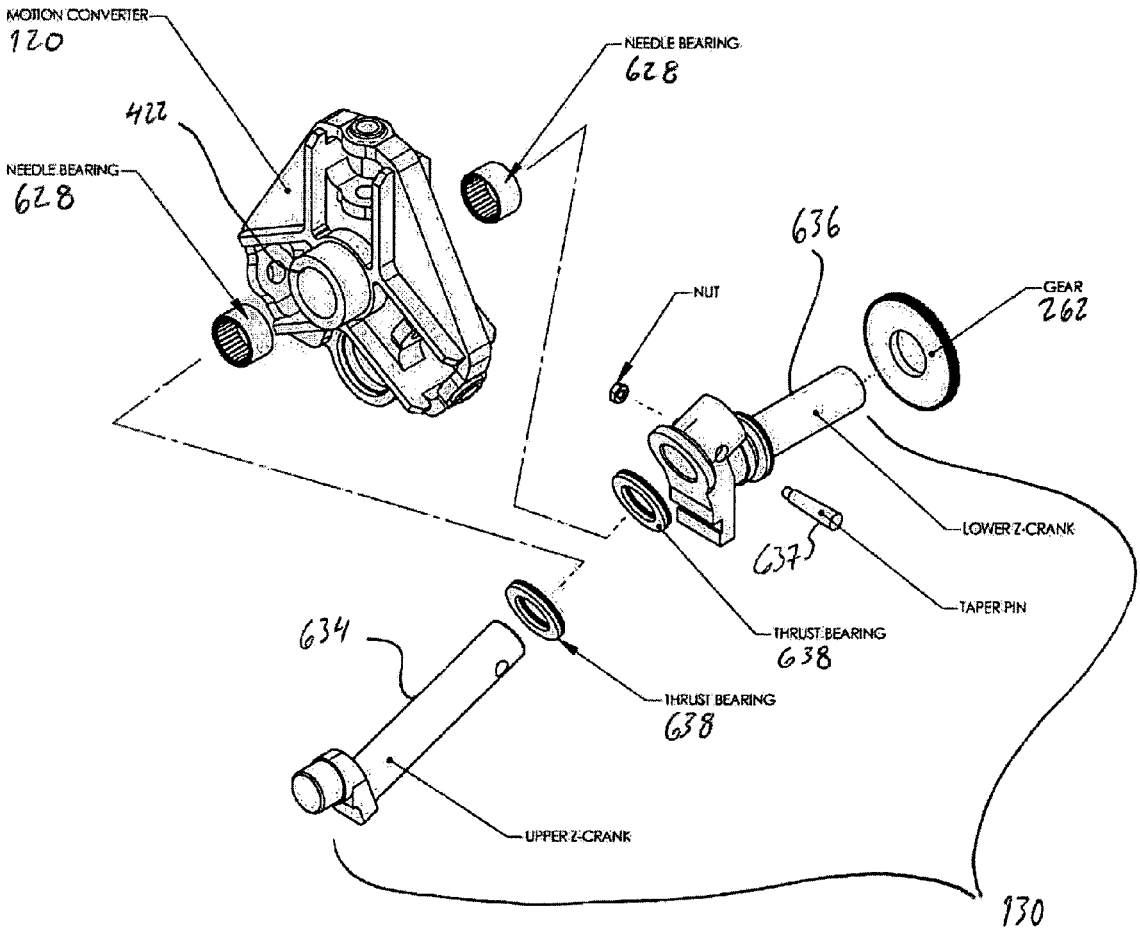
FIG. 6 is an exploded isometric view of the motion converter and the Z-crank of FIGS. 4 and 5 configured in accordance with embodiments of the invention.

FIG. 6 illustrates exploded isometric views of the motion converter 120 and the Z-crank 130 configured in accordance with embodiments of the invention. The embodiments illustrated in FIG. 6 are merely representative and, accordingly, and are not intended to limit the present invention to the configurations shown. Accordingly, in other embodiments, other components can be utilized to construct and practice the motion converter 120 and the Z-crank 130 of the present invention. In the illustrated embodiment, the Z-crank 130 can include an upper portion 634 mated to a lower portion 636 with a taper pin 637. Prior to mating, the upper Z-crank portion 634 can receive a thrust bearing 638 and can be inserted through the motion converter bore 422. After the upper Z-crank portion 634 is inserted through the motion converter bore 422, it can receive another thrust bearing 638 and be inserted into the lower Z-crank portion 636, thereby rotatably capturing the motion converter 120 on the Z-crank 130.

In another aspect of this embodiment, the motion converter 120 can include needle bearings 628 received in the motion converter bore 422. The needle bearings 628 facilitate rotational motion of the Z-crank 130 relative to the motion converter 120. In other embodiments, other bearings in other configurations can be used to provide rotational freedom of the Z-crank 130 relative to the motion converter 120.

Figure 7:
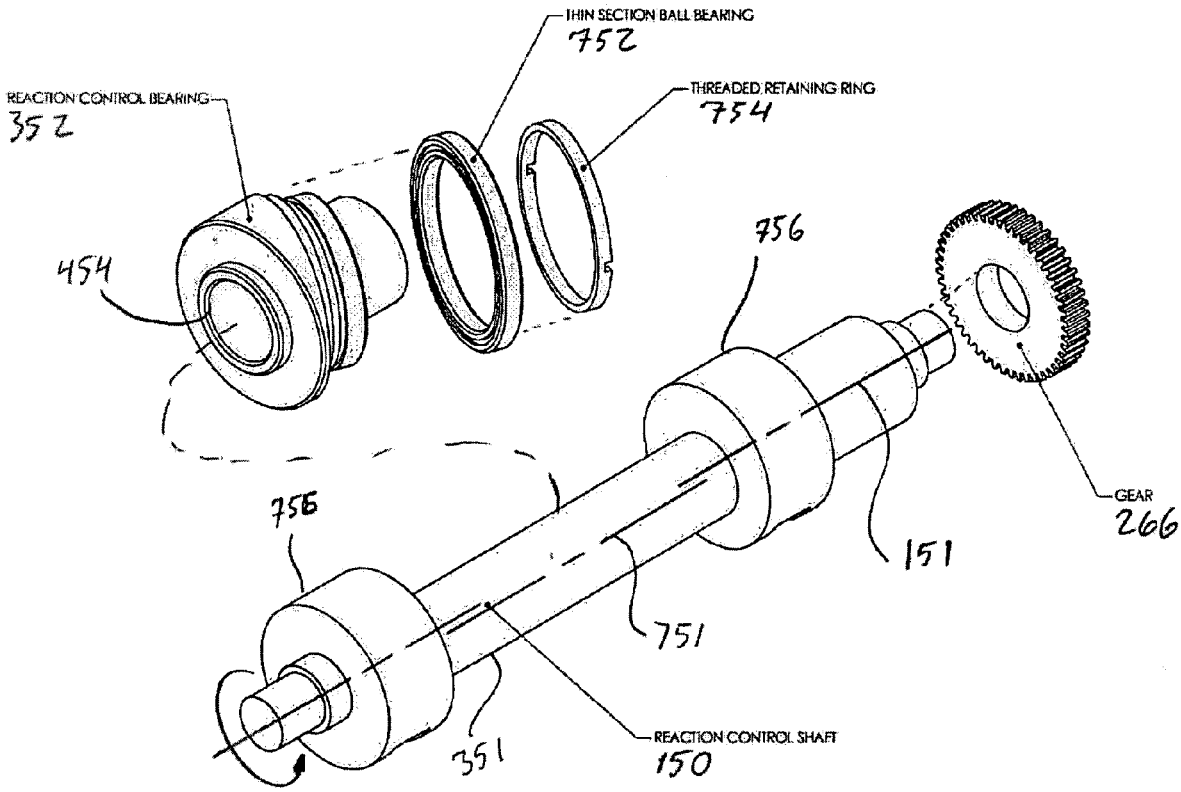
FIG. 7 is a partially exploded isometric view of the reaction control shaft of FIGS. 1–4 configured in accordance with an embodiment of the invention.

FIG. 7 is a partially exploded isometric view of the reaction control shaft 150 shown in FIGS. 1–4 above. In one aspect of this embodiment as mentioned above, the reaction control shaft gear 266 can be fixedly attached to a lower end of the reaction control shaft 150 to control the rotational motion of the reaction control shaft 150 about its rotational axis 151. As shown to good effect in FIG. 7, the offset bearing surface 351 is cylindrical in cross-section and has a centerline axis 751 that is offset relative to the rotational axis 151 of the reaction control shaft 150. In one aspect of this embodiment, this offset is necessary to facilitate the nutational motion of the motion converter 120. In another aspect of this embodiment, the reaction control shaft 150 can include counter-weights 756 which can be machined or otherwise conformed to rotationally balance the reaction control shaft 150 about its rotational axis 151.

In a further aspect of this embodiment, the reaction control bearing 454 includes a ball bearing 752 and a retaining ring 754. The ball bearing 752 is received on the reaction control bearing 352 at an angle relative to the reaction control bearing bore 454. In a further aspect of this embodiment, the angle of the ball bearing 752 accommodates the nutational movement of the motion converter 120 relative to the reaction control shaft 150 as the Z-crank 130 rotates. In addition, the ball bearing 752 allows the reaction control bearing 352 to rotate relative to the reaction control bearing bore 424 (FIG. 4) of the motion converter 120. This relationship between the ball bearing 752, the reaction control shaft 150, and the motion converter 120 can be seen with reference to FIG. 3. The retaining ring 754 can be threadably installed onto the reaction control bearing 352 to retain the ball bearing 752.

Prior to assembly of the reaction control shaft 150 (for example, prior to installing the first counterweight 756), the bearing surface 351 of the reaction control shaft 150 is inserted through the reaction control bearing bore 454 of the reaction control bearing 352. The first counterweight 755 can then be installed on the reaction control shaft 150.

The foregoing discussion describes one embodiment of the present invention for restricting rotational movement of the motion converter 120 as it nutates relative to the Z-crank rotational axis 131 (FIGS. 1–3). In other embodiments, other apparatuses and methods can be utilized to restrict this rotational movement without departing from the spirit or scope of the present invention. Specifically, other apparatuses and methods can be utilized to restrict this rotational movement while still enabling the variable compression features of the present invention. One such embodiment is described in greater detail below with reference to FIG. 8 and on.

Figure 8:
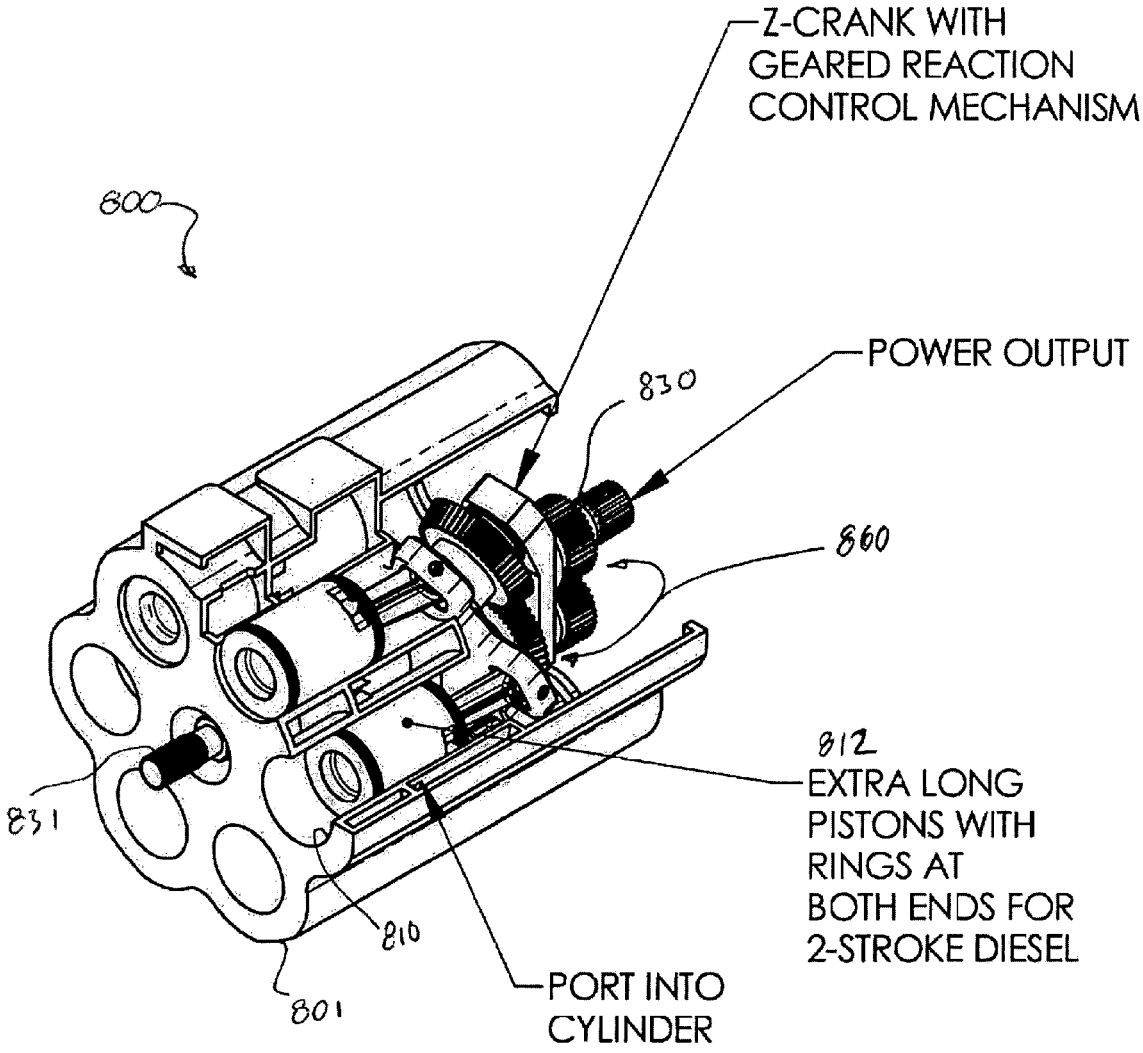
FIG. 8 is a partially cutaway isometric view of an axial piston apparatus having an anti-rotation gear train configured in accordance with another embodiment of the invention.

FIG. 8 is a partially cutaway isometric view of an axial piston apparatus 800 having an anti-rotation gear train 860 configured in accordance with another embodiment of the invention. Although the axial piston apparatus 800 of FIG. 8 includes six pistons 812 and associated hardware, this number is in no way limiting and, in other embodiments, the axial piston apparatus 800 can include more or fewer pistons 812. Similarly, although the illustrated embodiment may depict a two-stroke diesel engine configuration, in other embodiments, the anti-rotation gear train 860 and associated features can be utilized with other axial piston apparatuses (e.g., 4-stroke engine or pump apparatuses) configured in accordance with the present disclosure. In the illustrated embodiment, a forward splined portion 831 of a Z-crank 830 protrudes beyond an engine block or housing 801. As discussed above, the forward splined portion 831 can be utilized to drive a camshaft for, among other things, actuating inlet poppet valves for providing fuel mixture to combustion chambers in the cylinders 810.

Figure 9:
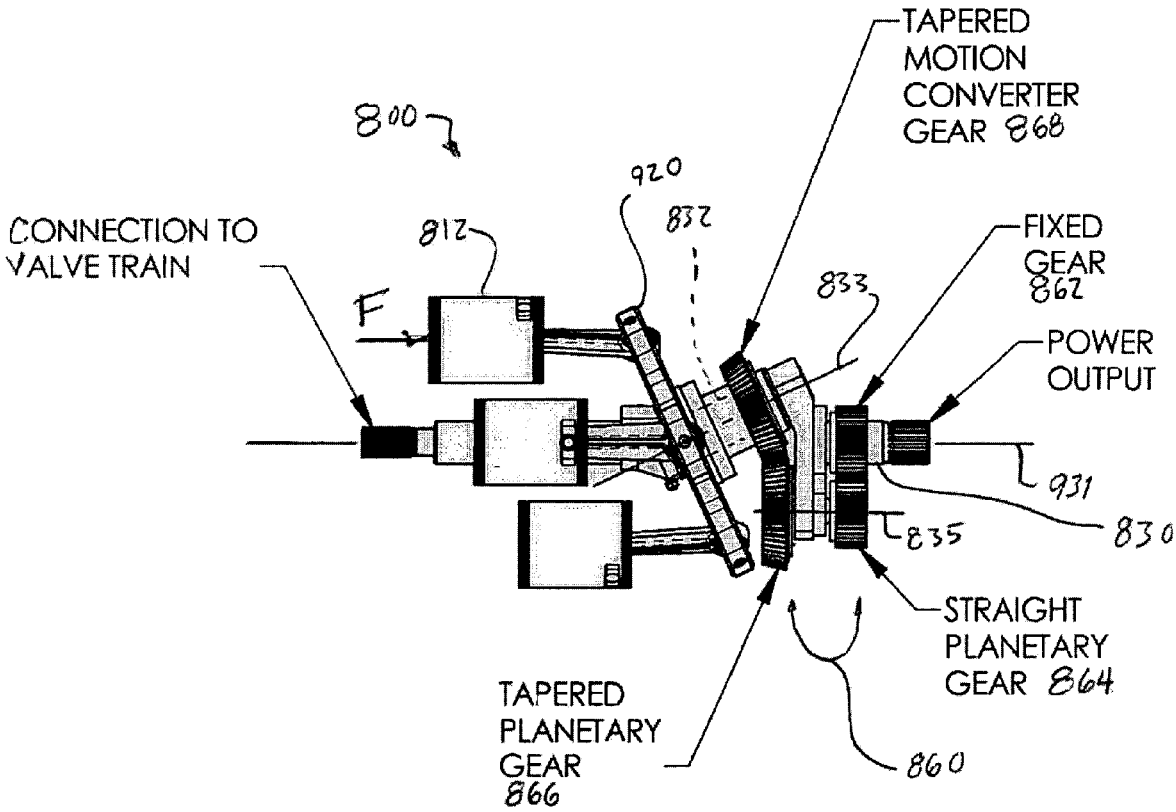
FIG. 9 is a side elevational view of the axial piston apparatus of FIG. 8 with portions removed for purposes of clarity in accordance with an embodiment of the invention.

FIG. 9 is a side elevation view of the axial piston apparatus 800 of FIG. 8 with the housing 801 removed to better illustrate aspects of the anti-rotation gear train 860 configured in accordance with an embodiment of the invention. As shown in FIG. 9, the anti-rotation gear train 860 replaces the reaction control shaft 150 described above and serves the same function, namely, to restrict rotational movement of a motion converter 920.

In one aspect of this embodiment, the anti-rotation gear train 860 (the "gear train 860") includes a fixed gear 862, a first planetary gear 864, a second planetary gear 866, and a motion converter gear 868. The fixed gear 862 can be fixedly mounted to a lower portion of the Z-crank 830 and meshed with the first planetary gear 864. In one embodiment, the fixed gear 862 and the planetary gear 864 can be straight gears. In other embodiments, these gears can have other configurations. In another aspect of this embodiment, the first planetary gear 864 can be fixedly mounted on a common shaft with the second planetary gear 866. Accordingly, the first and second planetary gears 864 and 866 are fixed relative to each other and rotate about a common axis 835. In a further aspect of this embodiment, the second planetary gear 866 can be beveled or tapered to mesh with the correspondingly tapered motion converter gear 868. The motion converter gear 868 can be rotatably mounted (e.g., with needle or roller bearings) to a bearing surface 832 of the Z-crank 830. Further, the motion converter gear 868 can be fixedly attached to the motion converter 920.

An example of the operation of the gear train 860 will now be explained in accordance with an embodiment of the invention in which a combustion force F drives the pistons 812 to provide shaft-power output from the Z-crank 830. In this embodiment, combustion gases move the pistons 812 causing the motion converter 920 to wobble or nutate relative to the Z-crank axis 931. As the motion converter 920 nutates, it causes the Z-crank 830 to rotate about its rotational axis 931. Simultaneously, however, the gear train 860 prevents the motion converter 920 from rotating relative to the nutational axis 833. Rotation of the motion converter 920 is prevented by the motion converter gear 868 which is fixed relative to the motion converter 920 and engaged with the second planetary gear 866. The second planetary gear 866 is fixed relative to the first planetary gear 864 which in turn meshes with the fixed gear 862. In a further aspect of this embodiment, the ratio of the fixed gear 862 to the first planetary gear 864 should be equal to the ratio of the motion converter gear 868 to the second planetary gear 866. When this ratio is met, the gear train 860 as illustrated in FIG. 9 can at least substantially prevent significant rotation of the motion converter 920.

If the motion converter 920 is allowed to rotate freely about the nutation axis 833 as the Z-crank 830 rotates, then the motion converter 920 cannot convert linear motion of the pistons 812 into torque at the Z-crank 830 nor, conversely, can the motion converter 920 convert torque from the Z-crank 830 into linear motion of the pistons 812. Accordingly, in an ideal situation, the motion converter 920 will move in a purely nutational motion without any substantial rotation.

Figure 10:
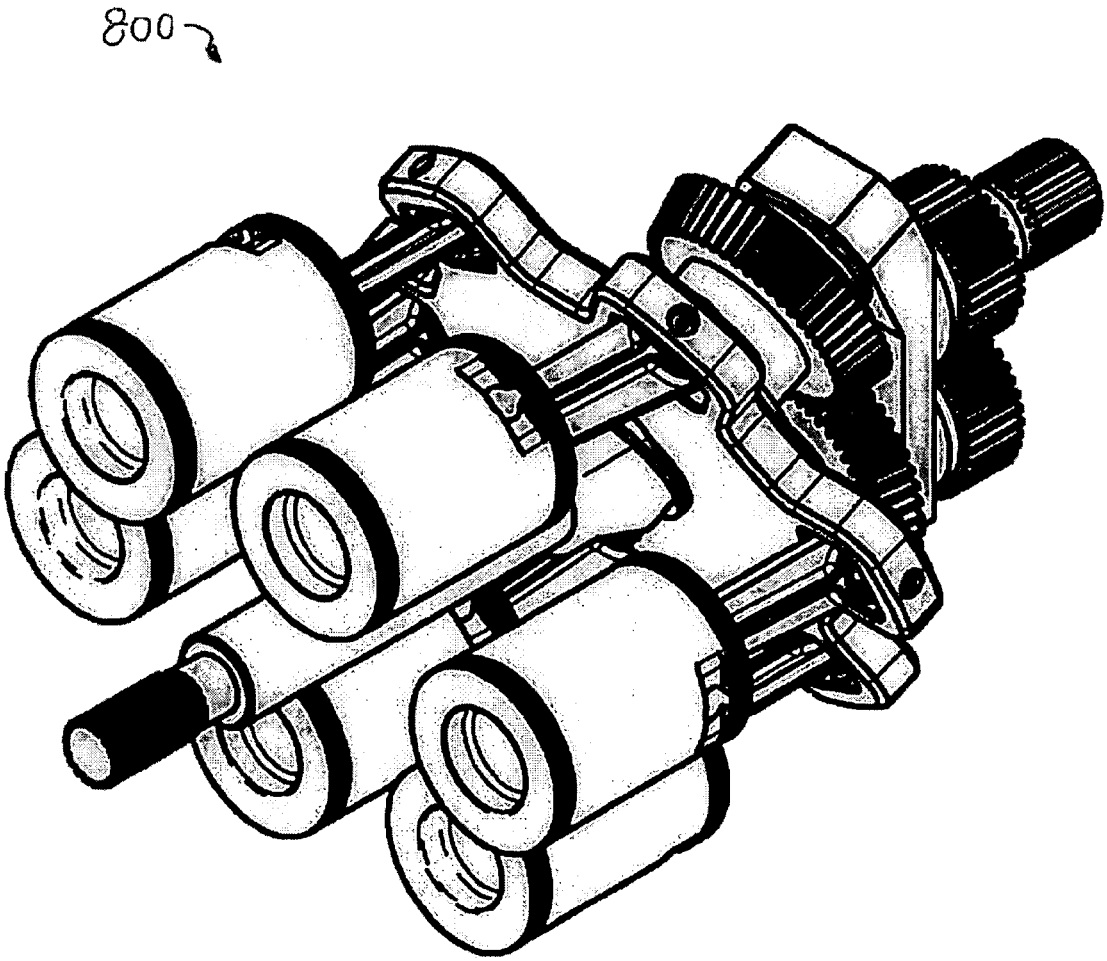
FIG. 10 is an isometric view of the axial piston apparatus of FIG. 9 configured in accordance with an embodiment of the invention.
Figure 11:
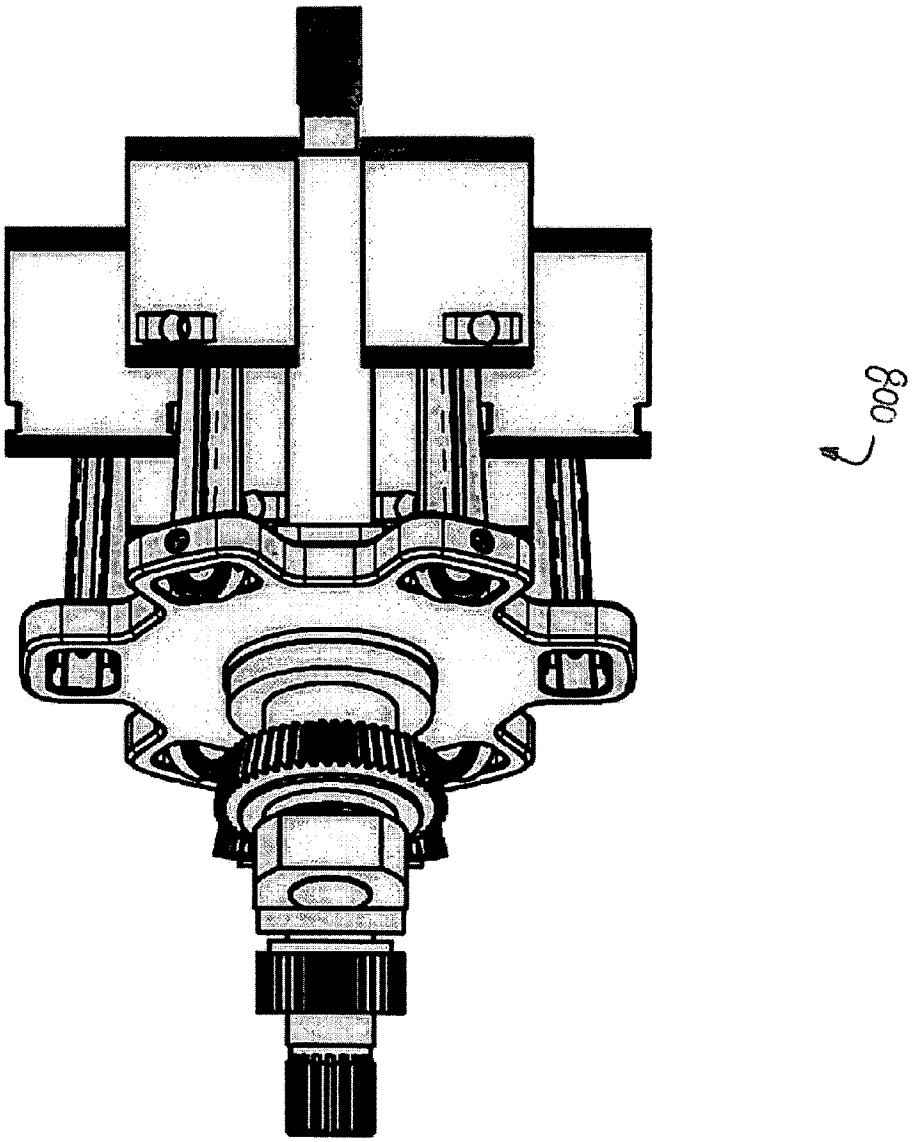
FIG. 11 is a top view of the axial piston apparatus of FIG. 9 configured in accordance with an embodiment of the invention.

FIGS. 10 and 11 are isometric and top views, respectively, illustrating further aspects of the axial piston apparatus 800 discussed above with reference to FIG. 9.

Figure 12:
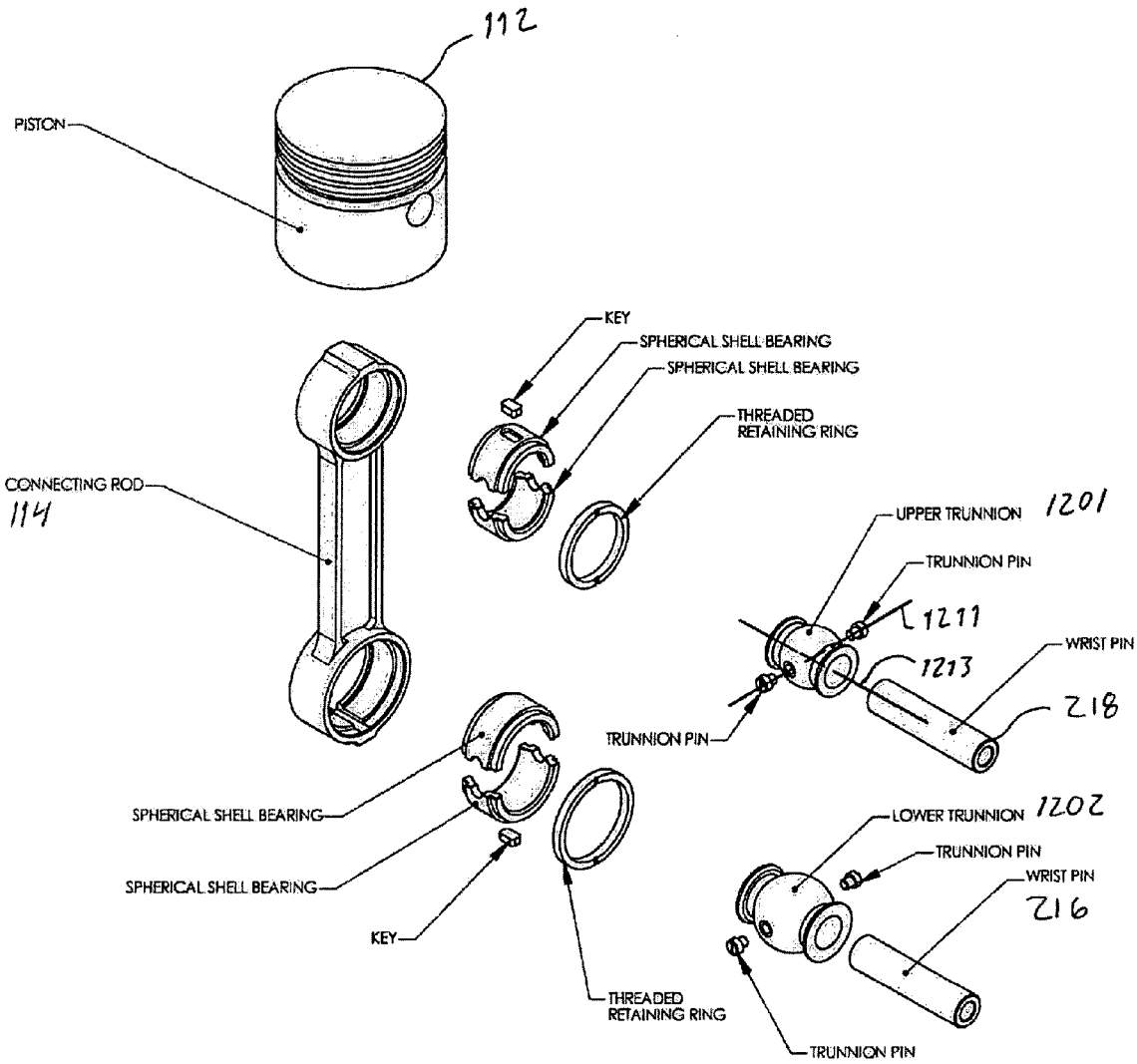
FIG. 12 is an exploded isometric view of a piston/connecting rod assembly configured in accordance with an embodiment of the invention.

FIG. 12 is an exploded isometric view of a piston/connecting rod assembly configured in accordance with an embodiment of the invention. In one aspect of this embodiment, the piston/connecting rod assembly shown in FIG. 12 can be at least generally similar to the double-articulating piston/connecting rod assemblies described above with reference to FIG. 2. For example, the upper wrist pin 218 can be received in an upper trunnion 1201 which pivotally connects the upper end (i.e., the "small end") of the connecting rod 114 to the piston 112. Similarly, the lower wrist pin 216 can be received in a lower trunnion 1201 which pivotally connects the lower end (i.e., the "big end") of the connecting rod 114 to a corresponding motion converter (e.g., the motion converter 120 or 920 described above). To accommodate rotation of the wrist pins about at least two axes, the trunnions 1201, 1202 can include a spherical surface and opposing trunnion pins. The spherical surface and opposing trunnion pins can be received within an interior portion of mating spherical shell bearings to accommodate rotation about a trunnion pin axis 1211 as well as rotation about a wrist pin axis 1213. A key or similar feature can be used to register the spherical shell bearings in the corresponding ends of the connecting rod 114. As will appreciated by those of ordinary skill in the relevant art, other methods and apparatuses can be utilized to pivotally connect the piston 112 to the connecting rod 14, and the connecting rod 14 to a corresponding motion converter, in accordance with the present disclosure. The embodiment illustrated in FIG. 12 represents only one such method.

Figure 14:
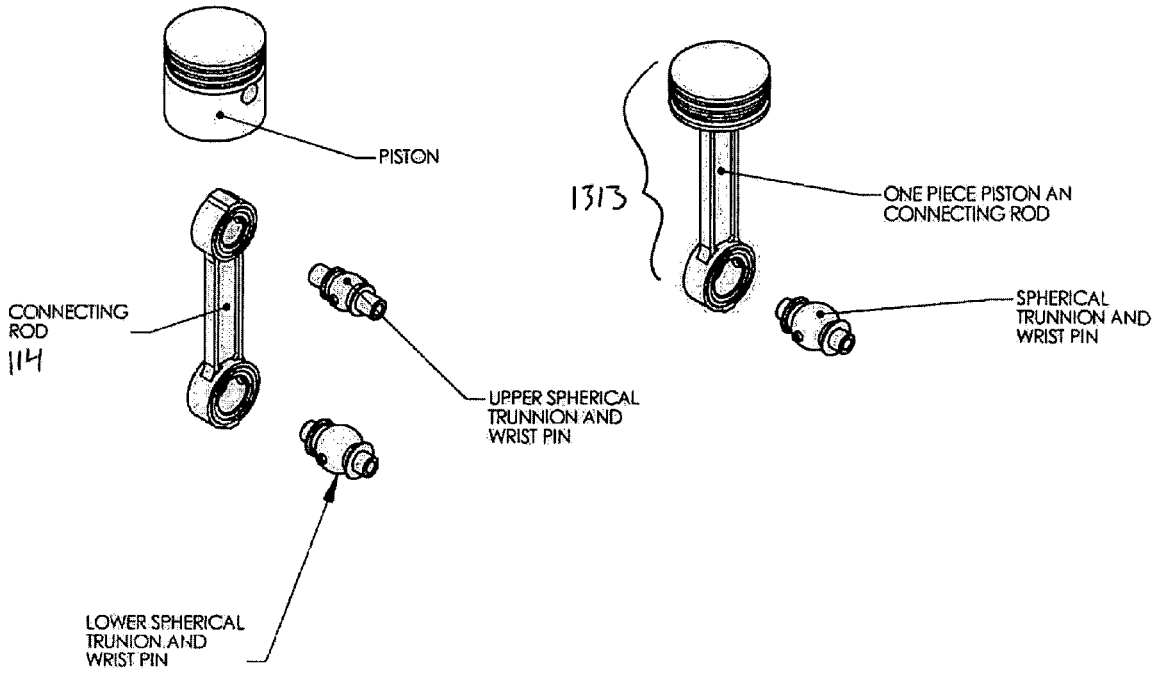
FIG. 14 is an exploded isometric view of a one-piece piston/connecting rod assembly configured in accordance with another embodiment of the invention.

FIG. 13 is an isometric view of an axial piston apparatus 1300 that is at least generally similar in structure and function to the axial piston apparatus 100 described above with reference to FIG. 1 through 5. In one aspect of this embodiment, however, the axial piston apparatus 1300 includes one-piece piston/connecting rod assemblies 1313. The one-piece piston/connecting rod assemblies 1313 can include a piston portion 1312 and a connecting rod portion 1314. The piston portion 1312 can have a spherical cross-section to accommodate slight angular motion of the connecting rod portion 1314 relative to the cylinder (not shown) resulting from the nutational movement of the motion converter 120. Such one-piece piston/connecting rod assemblies 1313 may, in certain embodiments, reduce the overall cost of the axial piston apparatus 1300 relative to other configurations. As shown in FIG. 14, for example, the one-piece piston/connecting rod assembly 1313 necessarily has a lower part count than a piston assembly having the double-articulated connecting rod 114.

Various aspects of the axial piston apparatuses described above can be combined to create engine and/or pump configurations in addition to those described above. For example, various dual-Z-crank configurations can be achieved in accordance with the present disclosure. Such dual-Z-crank configurations can include pistons facing towards each other in pairs sharing common cylinders. Alternatively, such configurations can include opposed cylinders facing outwardly relative to each other similar to two axial piston apparatuses positioned back-to-back. Such configurations may be advantageously self-counterbalancing and not require further counterbalancing via weights, etc.

Figure 15:
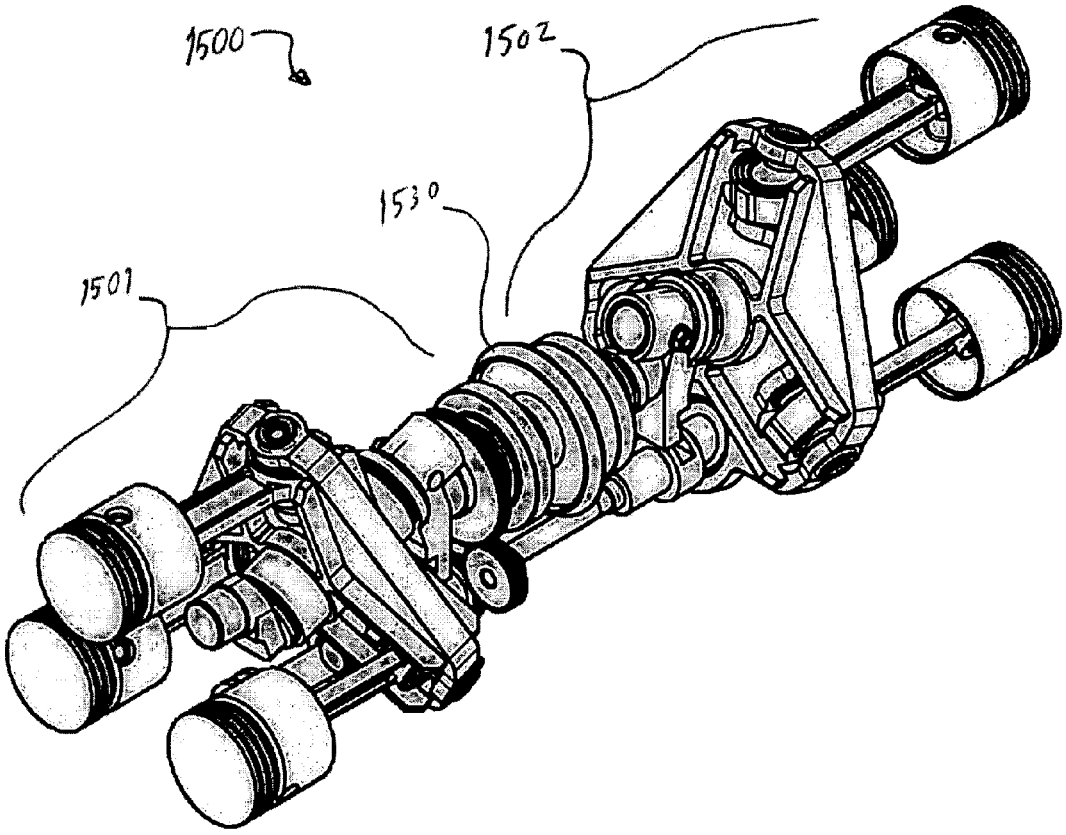
FIG. 15 is an isometric view of an axial piston apparatus having opposed cylinders facing outwardly from each other in a back-to-back arrangement in accordance with an embodiment of the invention.

FIG. 15 is an isometric view of an axial piston apparatus 1500 having a first axial piston apparatus 1501 operably coupled to a second axial piston apparatus 1502 in a back-to-back relationship. In one aspect of this embodiment, the combined apparatuses include two Z-cranks which are coupled together and provide shaft-power output via an output gear 1530. Various mechanical features of the axial piston apparatus 1500 illustrated in FIG. 15 can be at least generally similar in structure and function to their corresponding counterparts of the axial piston apparatus 100 described above. In addition, however, the axial piston apparatus 1500 can include a Z-crank actuator to simultaneously (or independently) move the coupled Z-cranks back and forth relative to each other on their rotational axis. Such movement can vary the compression in one or both sets of cylinders (not shown) to provide the variable compression aspects of the invention described above. When two complete axial piston apparatuses are coupled back-to-back as illustrated in FIG. 15, the reaction forces of the two motion converters can cancel out. Accordingly, counterbalancing of such apparatuses may not be required when the two opposing Z-cranks are in directly opposing phases relative to each other.

Figure 16:
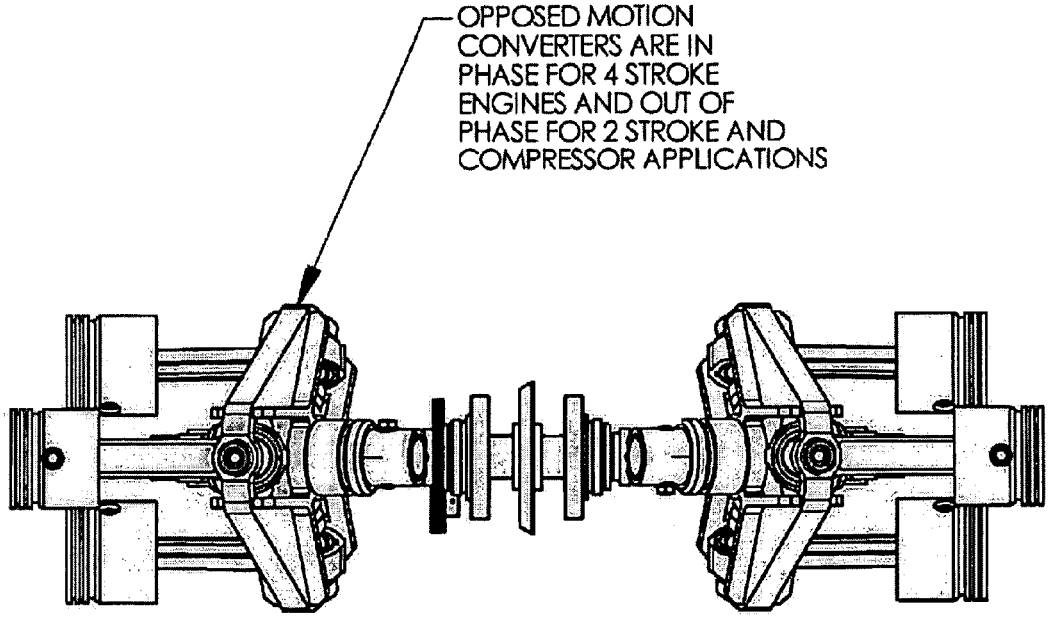
FIG. 16 illustrates a side elevation view and a top view of the axial piston apparatus of FIG. 15 in accordance with an embodiment of the invention.
Figure 16:
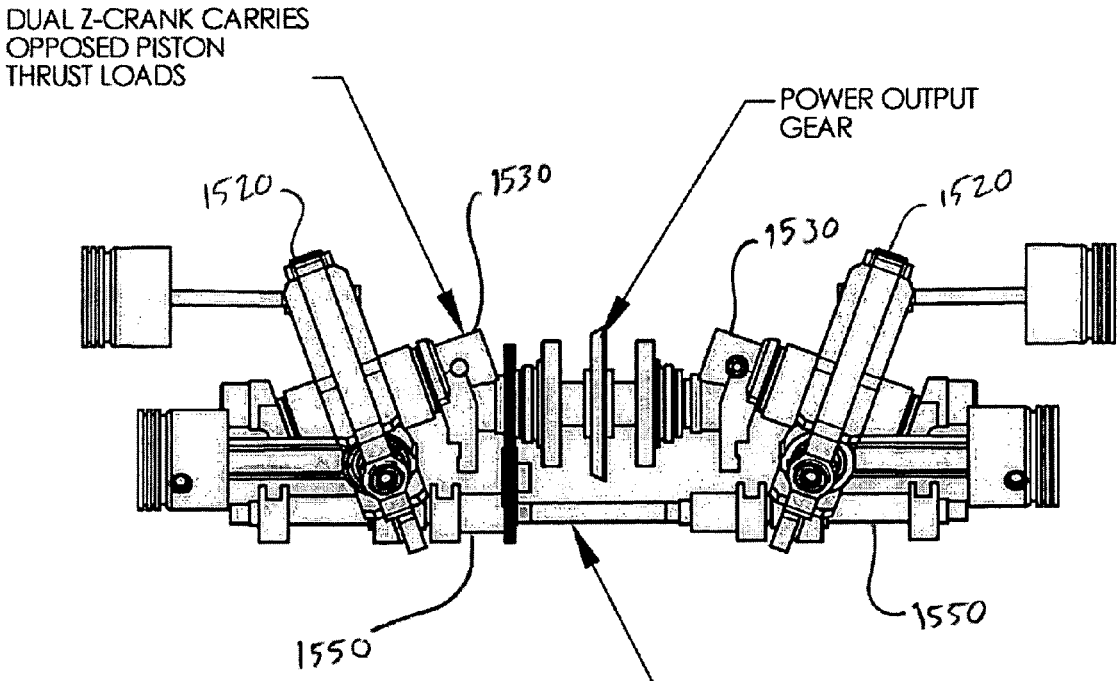

FIG. 16 illustrates a side elevation view and a top view of the axial piston apparatus 1500 of FIG. 15. As shown in the side elevation view, the opposing Z-cranks 1530 are coupled together as are the corresponding reaction control shafts 1550. In a further aspect of this embodiment, the opposed motion converters 1520 can be in phase for four-stroke engine applications and at least slightly out of phase for two-stroke engine applications and compressor or pump applications. Varying the phase for two-stroke engine applications and compressor or pump applications may be advantageous, in selected embodiments, to accommodate the intake port or outlet port timing arrangements in the cylinders of such applications. In other embodiments, however, the opposing motion converters 1520 can have other phase timings with respect to each other without departing from the spirit or scope of this disclosure.

Figure 17:
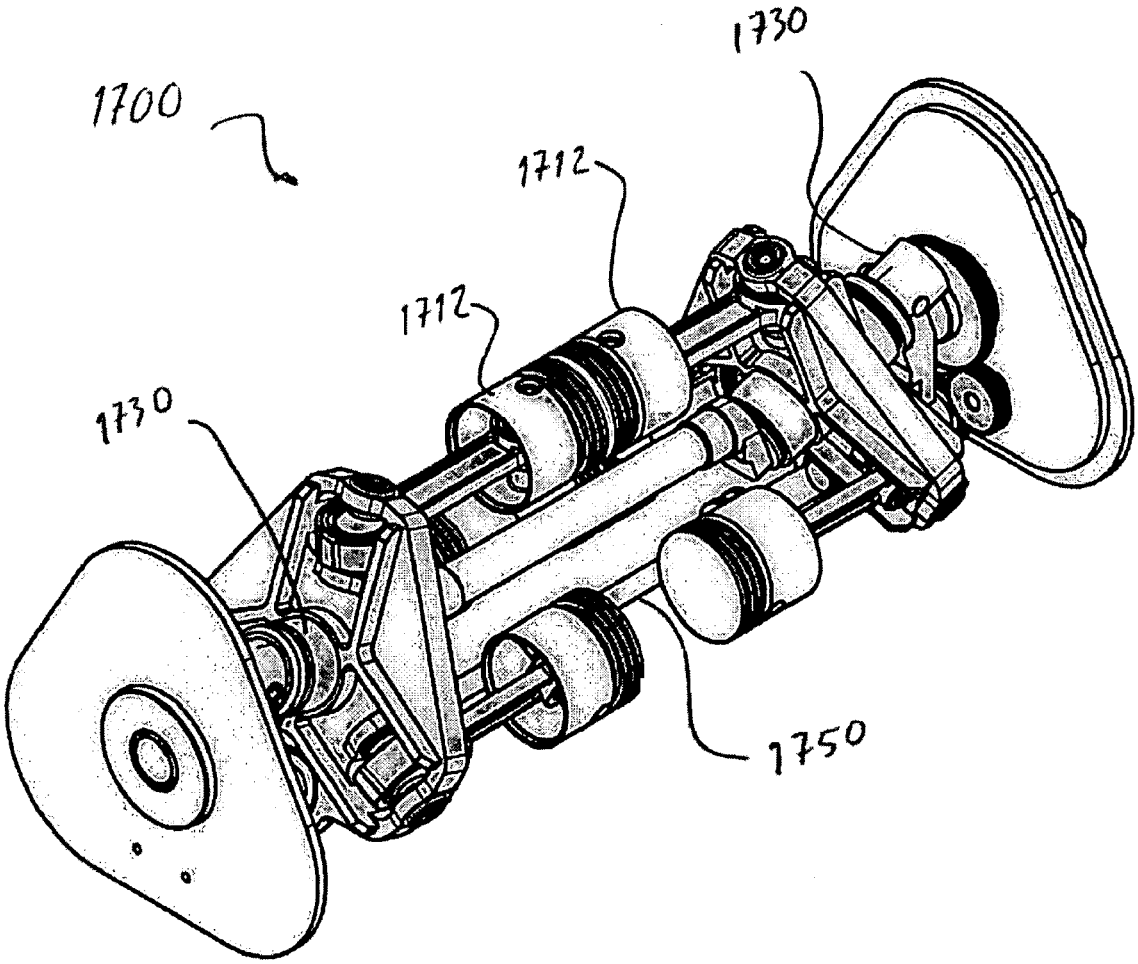
FIG. 17 is an isometric view of an axial piston apparatus having opposed pistons facing toward each other in pairs sharing a common cylinder in accordance with an embodiment of the invention.

FIG. 17 is an isometric view of an axial piston apparatus 1700 having an opposed piston configuration in accordance with yet another embodiment of the invention. In one aspect of this embodiment, opposing pistons 1712 linearly reciprocate in common cylinders (cylinders are not shown in FIG. 17). The axial piston apparatus 1700 can have coupled Z-cranks 1730 and coupled reaction control shafts 1750 similar to the axial piston apparatus 1500 shown in FIG. 15. In the embodiment depicted in FIG. 17, however, the variable compression features described above can be implement by moving one or both of the opposing Z-cranks toward or away from each other to accordingly change the working volumes in the corresponding cylinders. In a further aspect of this embodiment, the axial piston apparatus 1700 can be configured as a two-stroke engine utilizing exhaust and intake ports instead of poppet-type valves. In this embodiment, one or more exhaust ports can be positioned toward one end of a cylinder and one or more intake ports can be positioned toward the other end. The opposed Z-cranks 1730 may then be configured to operate slightly out of phase so that the exhaust ports on one end are open before the intake ports open on the other end. Such sequential timing may be desirable to maintain the momentum and/or flow direction of the fluid moving into and out of the corresponding cylinder volume. In a further embodiment, such an engine configuration may be supercharged or turbocharged to provide additional advantages depending on the particular application.

Figure 18:
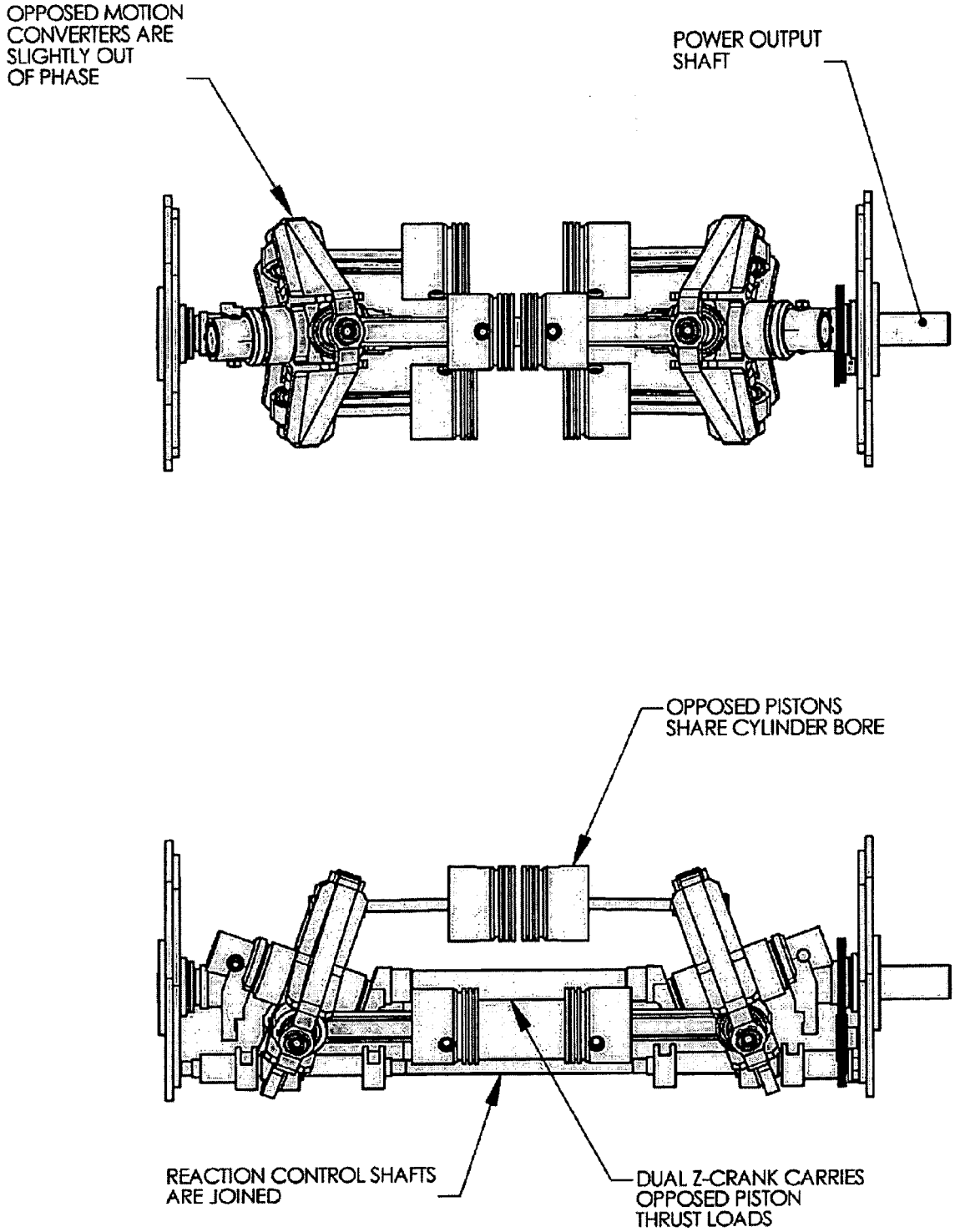
FIG. 18 illustrates a side elevation view and a top view of the axial piston apparatus of FIG. 17.

FIG. 18 illustrates a side elevation view and a top view of the axial piston apparatus 1700 of FIG. 17 to further illustrate aspects of this embodiment.

The foregoing description of the embodiments of the invention are not intended to be exhaustive or to limit the invention to the precise embodiments disclosed herein. While specific embodiments of, and examples for, the invention are described herein for illustrative purposes, various equivalent modifications are possible within the scope of the invention, as those of ordinary skill will recognize. For example, although certain functions may be described in the present disclosure in any particular order, and alternate embodiments, these functions can be performed in a different order or, alternatively, these functions may be performed substantially concurrently. In addition, the teachings of the present disclosure can be applied to other systems, not only the representative axial engine, compressor, pump systems described herein. Further, various aspects of the invention described herein can be combined to provide yet other embodiments.

Accordingly, aspects of the invention can be modified, if necessary or desirable, to employ the systems, functions, and concepts of conventional engine, pump and/or compressor apparatuses to provide yet further embodiments of the invention. These and other changes can be made to the invention in light of the above-detailed description. Accordingly, the actual scope of the invention encompasses the disclosed embodiments described above and all equivalent ways of practicing or implementing the invention.

Unless the context clearly requires otherwise, throughout this disclosure the words "comprise," "comprising," and the like are to be construed in an inclusive sense as opposed to an exclusive or exhaustive sense, that is to say, in the sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The following examples represent additional embodiments of axial piston apparatuses configured in accordance with the present disclosure.

What is claimed is:

1. An engine or other device having a Z-crank operated by axially arranged pistons and cylinders whose axes parallel the rotational axis of the Z-crank and where the motion converter is prevented from rotating as it nutates by means of:

a) a reaction control shaft b) the axis of rotation of which is parallel to the axis of rotation of the Z-crank c) the reaction control shaft, having a cylindrical section parallel to and offset from its axis of rotation d) so as to provide an eccentric bearing surface e) for a bushing mounted to the motion converter f) that rotates relative to the motion converter and slides and rotates relative to the reaction control shaft g) where the reaction control shaft is driven by gears or other means to rotate at twice the Z-crank speed.

2. An engine or other device as described in claim 1 where there are two complete sets of motion converters, connecting rods and pistons combined face-to-face and there is a double Z-crank.

3. An engine or other device as described in claim 1 where there are two complete sets of motion converters, connecting rods and pistons combined back-to-back and there is a double Z-crank.

4. An engine or other device having a Z-crank operated by axially arranged pistons and cylinders whose axes parallel the rotational axis of the Z-crank and where the motion converter is prevented from rotating as it nutates by means of:

a) a stationary gear coaxial to the axis of rotation of the Z-crank and fixed to the engine housing b) engaged with a planetary gear carried on the Z-crank c) the planetary gear and a third gear fixed together d) the third gear engaged with a fourth gear that is fixed to the motion converter e) the ratio between the planetary gear and the stationary gear is the same as the ratio between the third gear and the fourth gear.

5. An engine or other device as described in claim 4 where there are two complete sets of motion converters, connecting rods and pistons combined face-to-face and there is a double Z-crank.

6. An engine or other device as described in claim 4 where there are two complete sets of motion converters, connecting rods and pistons combined back-to-back and there is a double Z-crank.

7. An engine or other device having a Z-crank operated by axially arranged pistons and cylinders whose axes parallel the rotational axis of the Z-crank and where the Z-crank is provided with splines or other means at both ends to allow for axial movement of the Z-crank relative to its output connection and flywheel and its valve gear and accessory drive.

8. An engine or other device as described in claim 7 where there are two complete sets of motion converters, connecting rods and pistons combined face-to-face and there is a double Z-crank.

9. An engine or other device as described in claim 7 where there are two complete sets of motion converters, connecting rods and pistons combined back-to-back and there is a double Z-crank.

10. An engine or other device having a Z-crank operated by axially arranged pistons and cylinders whose axes parallel the rotational axis of the Z-crank and where the compression ratio of the device is automatically varied during operation by means of:

a) a mechanical actuator b) electronically controlled by an engine control unit c) that displaces the Z-crank and motion converter along its axis d) in response to variations in power demand, load and other conditions e) as input to the engine control unit from sensors.

11. An engine or other device as described in claim 10 where there are two complete sets of motion converters, connecting rods and pistons combined face-to-face and there is a double Z-crank.

12. An engine or other device as described in claim 10 where there are two complete sets of motion converters, connecting rods and pistons combined back-to-back and there is a double Z-crank.

13. An engine or other device having a Z-crank operated by axially arranged pistons and cylinders whose axes parallel the rotational axis of the Z-crank and where the connecting rods are provided at one or both ends with split shell bearings having:

a) a spherical surface on the inner surface of the bearing b) a cylindrical surface on the outer surface of the bearing c) a means for locating and fixing the bearing to the connecting rod d) auxiliary cylindrical bearing surfaces to engage trunnion pins and concentrically supporting a trunnion having:

a) a spherical outer surface b) a cylindrical inner surface for interface to a wrist pin c) cylindrical trunnion pins to prevent rotation of the connecting rod about its long axis.

14. An engine or other device having a Z-crank operated by axially arranged pistons and cylinders whose axes parallel the rotational axis of the Z-crank where:

a) the piston and associated connecting rod are fixed together b) the outside of the piston is tapered at one or both ends c) the largest diameter section of the piston is spherical in shape and is slightly smaller in diameter than the cylinder into which it is fitted.

15. An engine or other device having a Z-crank operated by axially arranged pistons and cylinders whose axes parallel the rotational axis of the Z-crank where:

a) the piston and associated connecting rod are combined into a single piece b) the outside of the piston is tapered at one or both ends c) the largest diameter section of the piston is spherical in shape and is slightly smaller in diameter than the cylinder into which it is fitted.

* * * * *